US007650653B2

(12) United States Patent
Johnson et al.

(10) Patent No.: US 7,650,653 B2
(45) Date of Patent: Jan. 26, 2010

(54) MODULAR ELECTRICALLY-OPERATED FAUCET

(75) Inventors: Dwight N. Johnson, Carlsbad, CA (US); Anthony Raul Martinez, Lake Villa, IL (US); James Bobic, Niles, IL (US); Silvio Marti, Schaumburg, IL (US)

(73) Assignee: Geberit Technik AG (CH)

( * ) Notice: Subject to any disclaimer, the term of this patent is extended or adjusted under 35 U.S.C. 154(b) by 614 days.

(21) Appl. No.: 11/273,168

(22) Filed: Nov. 14, 2005

(65) Prior Publication Data

US 2007/0108400 A1 May 17, 2007

(51) Int. Cl.
*E03C 1/05* (2006.01)

(52) U.S. Cl. ..... 4/623; 4/695; 251/128; 251/367

(58) Field of Classification Search ..... 251/129.04, 251/128, 367; 137/801; 4/623, 695, 678
See application file for complete search history.

(56) References Cited

U.S. PATENT DOCUMENTS 3,480,757 A 11/1969 Johansen
3,480,787 A 11/1969 Johansen
3,576,277 A 4/1971 Blackman
3,670,167 A 6/1972 Forbes
4,356,574 A 11/1982 Johnson
4,709,728 A 12/1987 Ying-Chung
4,735,357 A 4/1988 Gregory et al.
4,767,922 A 8/1988 Stauffer
4,886,207 A 12/1989 Lee et al.
4,915,347 A 4/1990 Iqbal et al.
4,955,535 A 9/1990 Tsutsui et al.
5,224,509 A 7/1993 Tanaka et al.
5,238,022 A * 8/1993 Zink ..... 137/554
5,586,746 A 12/1996 Humpert et al.
5,611,517 A 3/1997 Saadi et al.
5,618,023 A 4/1997 Eichholz et al.
5,893,387 A 4/1999 Paterson et al.
5,911,240 A 6/1999 Kolar et al.
5,918,855 A 7/1999 Hamanaka et al.
5,961,095 A * 10/1999 Schrott ..... 251/129.04
5,988,588 A 11/1999 Allen et al.
6,082,407 A 7/2000 Paterson et al.
6,202,980 B1 3/2001 Lott et al.

(Continued)

FOREIGN PATENT DOCUMENTS

DE 1934659 A1 1/1971

(Continued)

*Primary Examiner*—John Bastianelli
(74) *Attorney, Agent, or Firm*—Reinhart Boerner Van Deuren S.C.

(57) ABSTRACT

A self-contained, modular electrically-operated faucets is disclosed which has all of its components which are likely to need replacement over the life of the device contained in removable modules which may be quickly and easily removed and replaced without necessitating the removal of the device from its installed location. The modular electrically-operated faucet of the present invention is configurable to be either deck mountable or wall mountable, and to allow either a conventional faucet spout or a gooseneck spout to be mounted thereupon. Optionally, when the modules of the modular electrically-operated faucet of the present invention are accessed for removal and replacement, the flow of water through the device may be automatically deactivated by merely removing the housing of the modular electrically-operated faucet.

27 Claims, 27 Drawing Sheets

U.S. PATENT DOCUMENTS

| | | | |
|---|---|---|---|
| 6,273,394 | B1 | 8/2001 | Vincent et al. |
| 6,420,737 | B1 | 7/2002 | Fan |
| 6,425,415 | B2 | 7/2002 | Lorenzelli et al. |
| 6,478,285 | B1 | 11/2002 | Bergmann |
| 6,619,320 | B2 | 9/2003 | Parson |
| 6,671,898 | B1 | 1/2004 | Eggenberger et al. |
| 6,691,340 | B2 | 2/2004 | Honda et al. |
| 7,069,941 | B2 | 7/2006 | Parsons et al. |
| 2003/0093857 | A1 | 5/2003 | Paterson |
| 2004/0164261 | A1 | 8/2004 | Parsons et al. |
| 2005/0006326 | A1 | 1/2005 | Josefsson |
| 2005/0040122 | A1 | 2/2005 | Ahlund et al. |

FOREIGN PATENT DOCUMENTS

| | | | |
|---|---|---|---|
| DE | 9012411 | U1 | 11/1990 |
| DE | 4420330 | A1 | 12/1995 |
| DE | 20110197 | U1 | 8/2001 |
| DE | 10148675 | C1 | 12/2003 |
| EP | 0391765 | A1 | 10/1990 |
| EP | 0701028 | A1 | 3/1996 |
| EP | 1512799 | A1 | 3/2005 |
| JP | 01079482 | | 3/1989 |
| JP | 1079482 | | 3/1989 |
| JP | 2140337 | | 5/1990 |
| JP | 02140337 | | 5/1990 |

* cited by examiner

FIG. 19
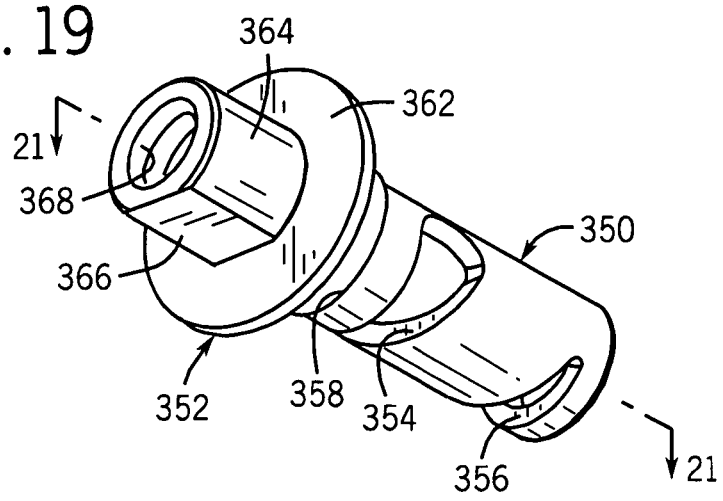
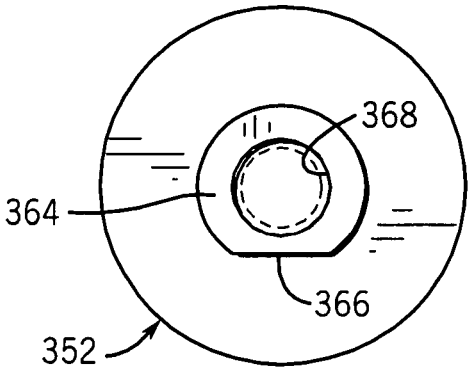
FIG. 20
FIG. 21
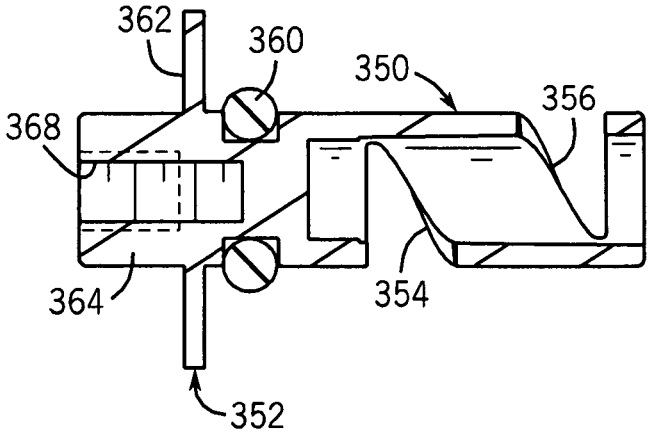
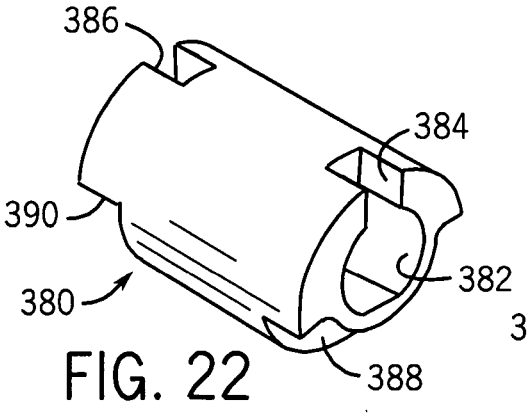
FIG. 22
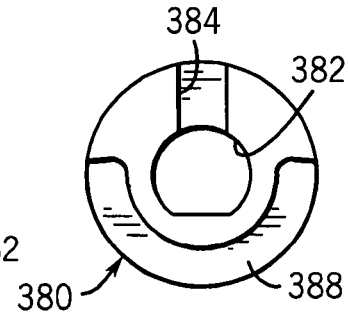
FIG. 23
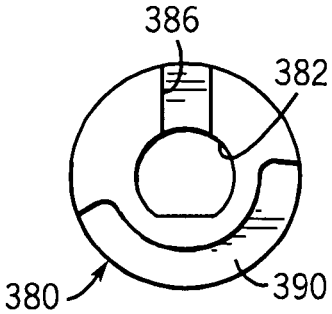
FIG. 24

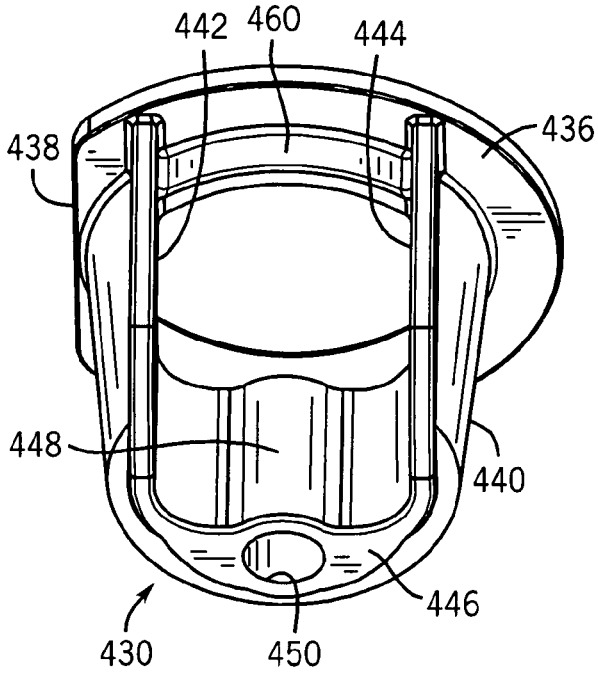
FIG. 29
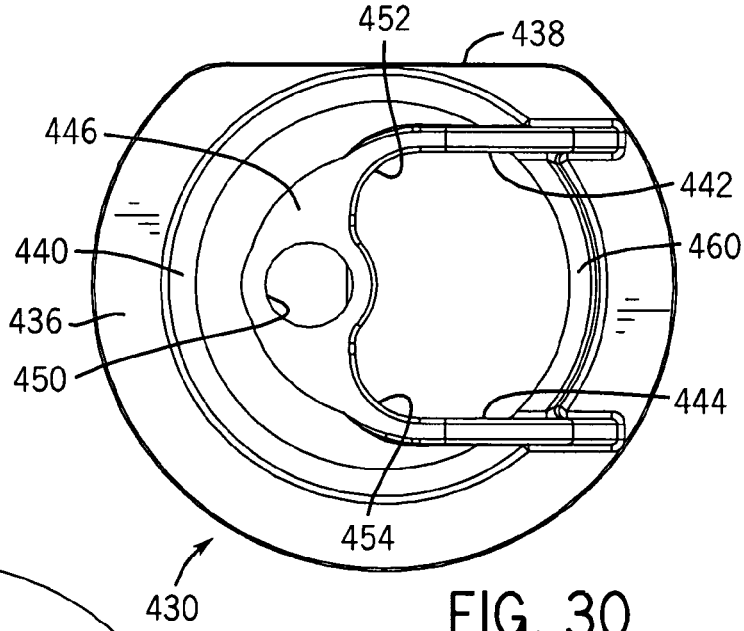
FIG. 30
FIG. 31
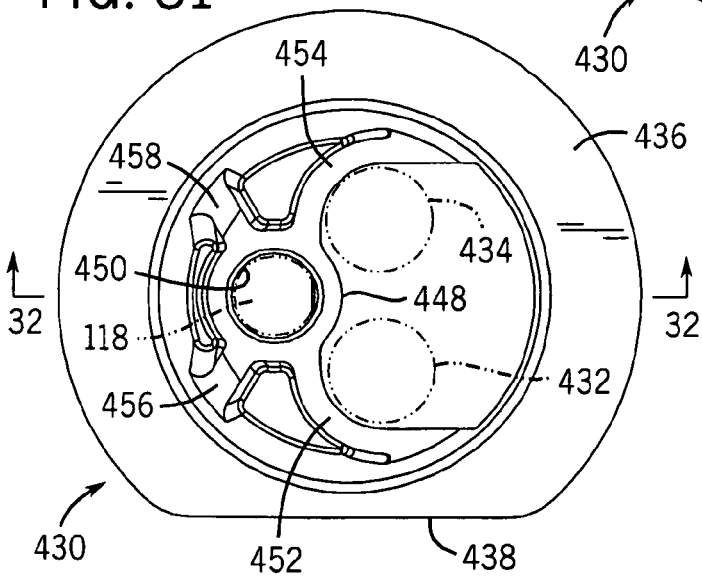

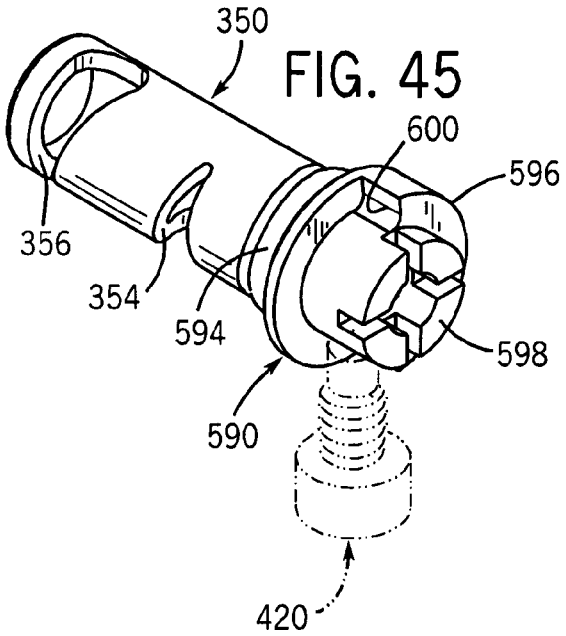
FIG. 45
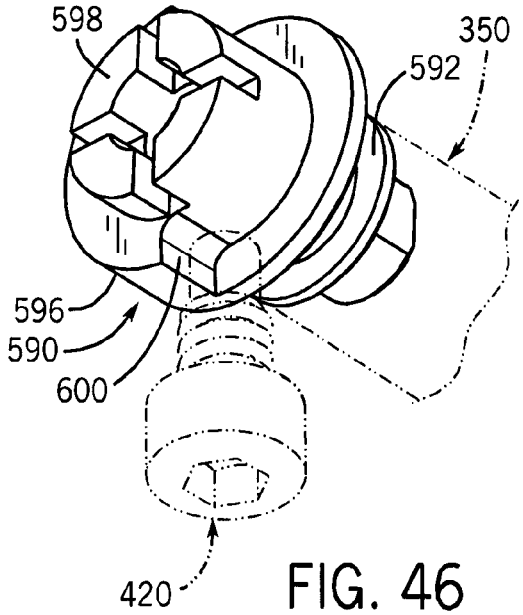
FIG. 46
FIG. 47
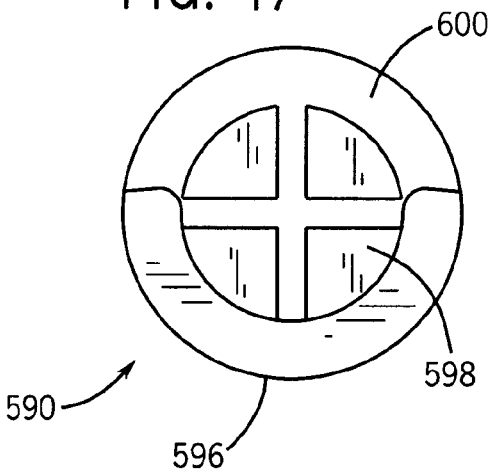
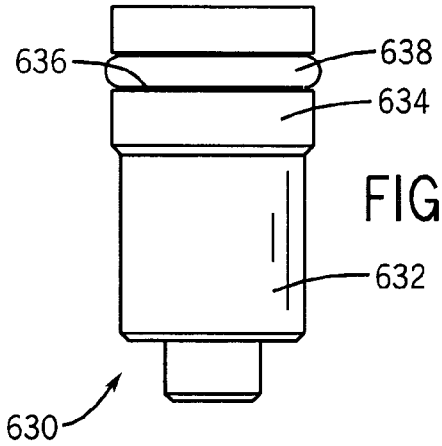
FIG. 49
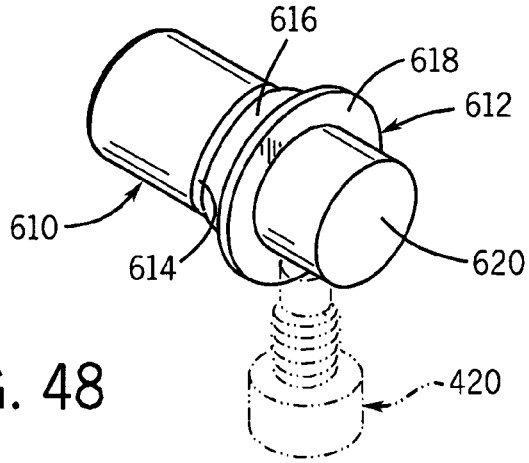
FIG. 48

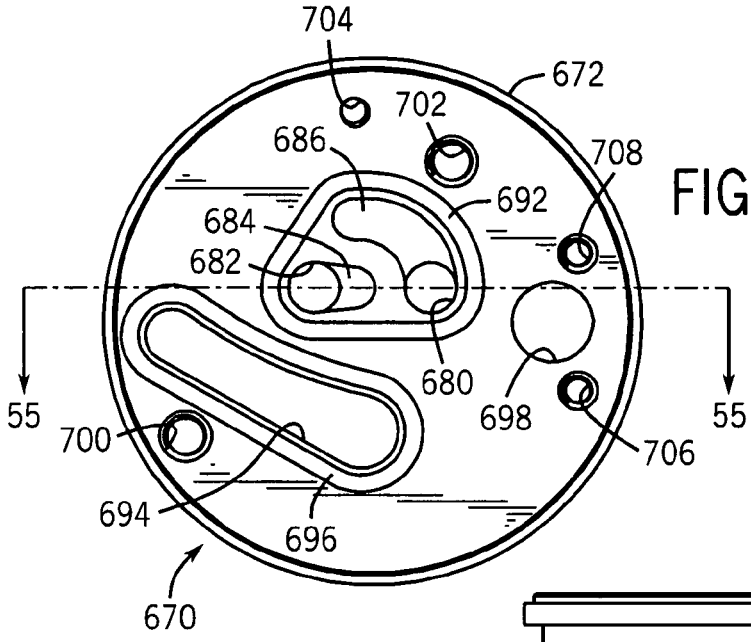
FIG. 52
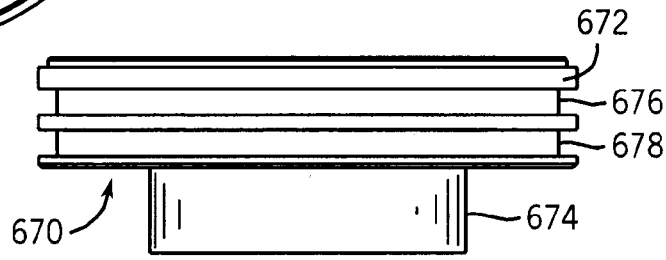
FIG. 54
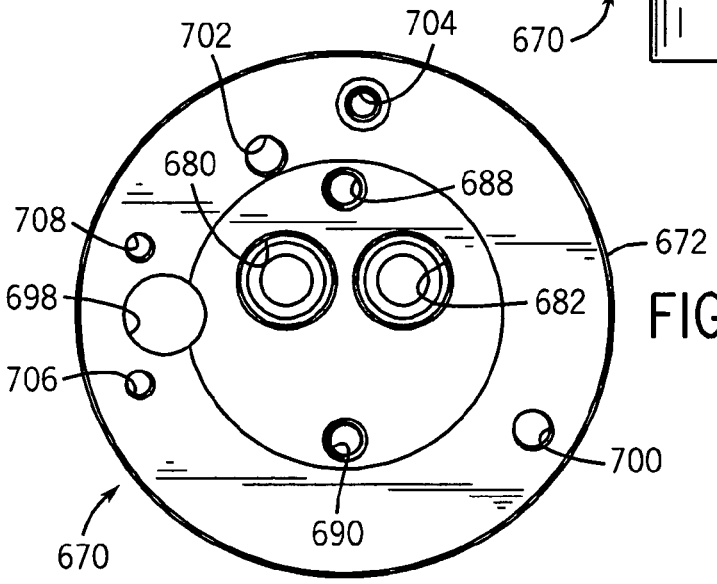
FIG. 53
FIG. 55
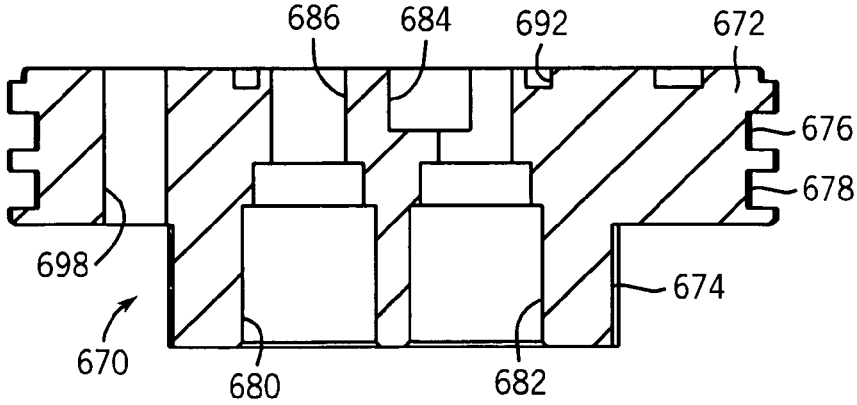

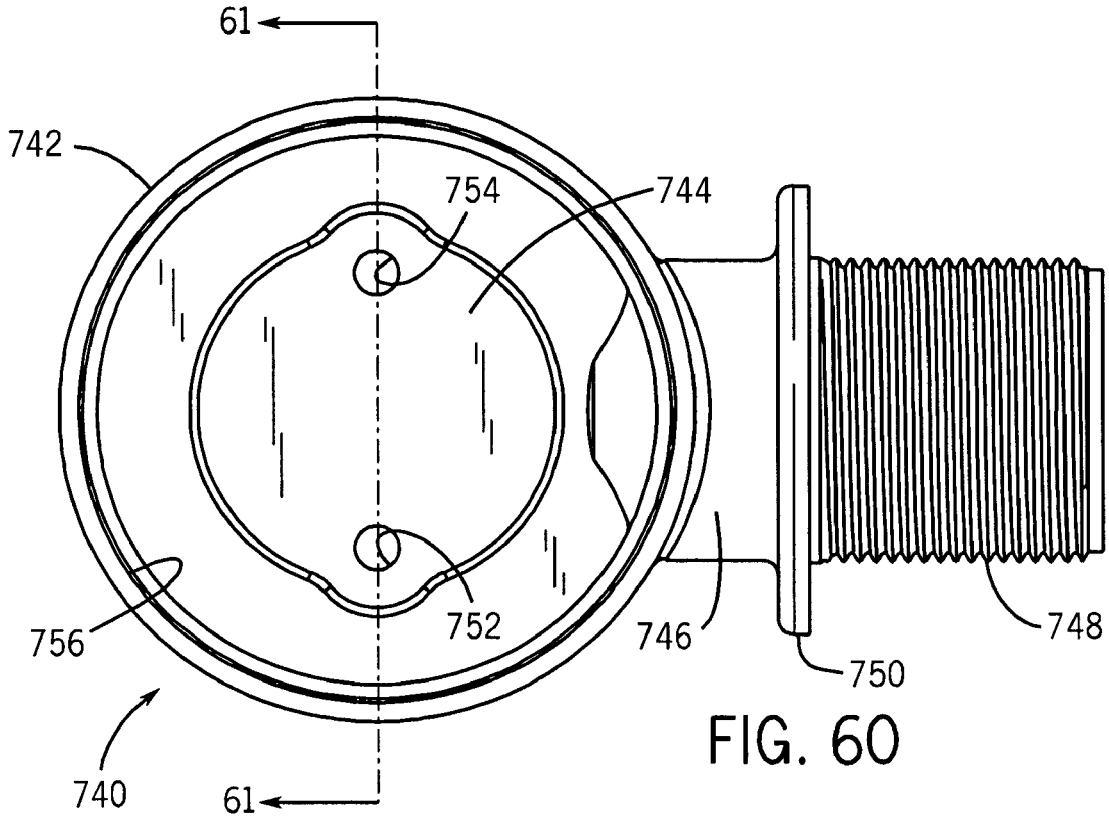
FIG. 60
FIG. 61
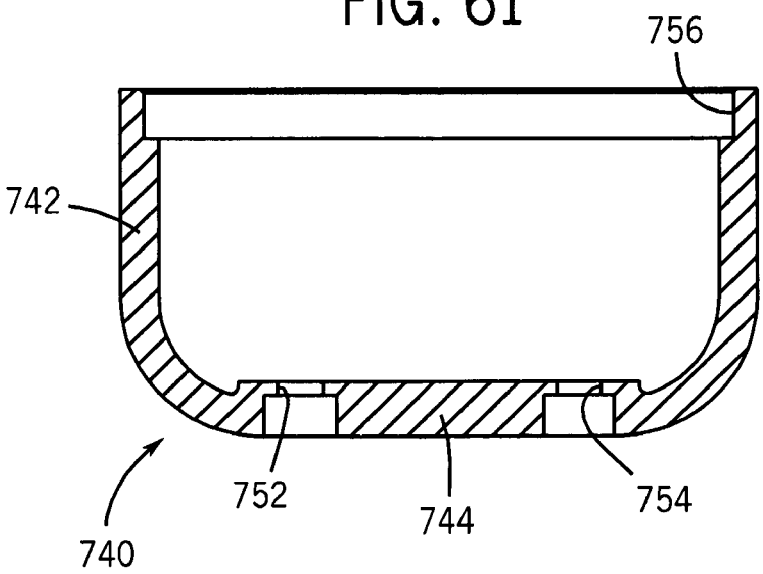

MODULAR ELECTRICALLY-OPERATED FAUCET

BACKGROUND OF THE INVENTION

Field of the Invention

The present invention relates generally to electrically-operated faucets which are activated by detecting the presence of an object in front of the faucet proximate a position under the faucet spout, and more particularly to an improved self-contained modular electrically-operated faucet having all components likely to need replacement over the life of the device contained in removable modules which may be quickly and easily removed and replaced without necessitating the removal of the device from its installed location.

Over the recent past, electronic faucets have become increasingly common in the restrooms of public and commercial buildings. Such electronic faucets are actuated by the user placing his or her hand or hands in proximity to a sensor which is located to detect when the user's hands are in a position proximate the spout of the faucet. The electronic faucet initiates the flow of water when the user's hand or hands are detected by the sensor and typically stops the flow of water several seconds after the user's hand or hands are no longer detected proximate the spout of the faucet, thereby allowing use of the faucet without requiring the user to make physical contact with the faucet. Such electronic faucets effectively prevent the spread of germs by eliminating the need for users to make physical contact with the faucet.

The early development of electronically-operated faucets relied upon the use of bulky sensors which made it necessary to place the components outside of the faucet itself. For example, U.S. Pat. No. 3,480,787, to Johansen, U.S. Pat. No. 3,567,277, to Blackmon, and U.S. Pat. No. 3,670,167, to Forbes, respectively controlled the flow of water in a faucet based upon detecting the proximity of a user's hand or hands to the spout of the faucet, the placement of one of the user's hand into a light beam (or light beams) in a control member located near the faucet, or the presence of a user in front of a sink on which the faucet was mounted. Nearly two decades later, improvements in optical components resulted in the adaptation of infrared sensors for the same use, with the infrared sensors being located in the faucet itself, as shown in U.S. Pat. No. 4,709,728, to Ying-Chung, and in U.S. Pat. No. 4,767,922, to Stauffer.

Many electrically-operated faucets have been implemented by placing at least some of the components outside the faucet itself, with only the infrared sensors (the infrared light source, typically an infrared light-emitting diode ("LED"), and the reflected infrared light detector, typically an infrared light-detecting photodiode) generally being located in the faucet assembly. An example of such an implementation is shown in U.S. Pat. No. 5,988,588, to Allen et al., which has a control module containing a solenoid valve used to control water flow to the faucet, a battery pack, and a printed circuit ("PC") board contained in a control module which may be mounted under a counter or in a cabinet on which the faucet is mounted. Thus, the Allen et al. device has the flexibility of at least somewhat modular construction, but it is disadvantageous in that it is not of one-piece construction and that it is more complex and time-consuming to install than a one-piece faucet is.

While those skilled in the art have recognized the benefits of modular construction in some ways, it has generally not been in the modularity of construction that would make electrically-operated faucets easier to service. See, for example, U.S. Pat. No. 4,735,357, to Gregory et al., which used modular construction to assemble different faucets out of common modules. Unfortunately, Gregory et al. placed all of the components of the electrically-operated faucet into modules which required the complete disassembly of the faucet, and potentially even the complete removal of the faucet prior to such disassembly, in order to service it.

Up to the present, while the construction of electrically-operated faucets has improved, they still remain relatively difficult to service. Examples of such electrically-operated faucets are found in U.S. Pat. No. 5,618,023, to Eichholz et al., U.S. Pat. No. 5,586,746, to Humpert et al., and U.S. Pat. No. 6,7671,898, to Eggenberger et al., the last of which is assigned to the assignee of the present patent application. The Eichholz et al. and Humpert et al. patents, which disclose the same device, are focused upon eliminating the need to service the device by replacing a battery with an AC-powered battery-replacement unit, with the wire to the battery-replacement unit going from the faucet to a position under the deck on which the faucet is mounted where an AC adapter is located. Thus, Eichholz et al. and Humpert et al., rather than attempting to make the device easier to service, are attempting to obviate the need to work on the device, at least for the purpose of battery replacement.

The Eggenberger et al. device, in recognition of the need to access the device for replacement of the battery and potentially for other types of servicing, provides a sensor which detects when the housing is being removed and deactivates the solenoid valve to ensure that it is not actuated to allow the flow of water therethrough during servicing of the device. It will thus be recognized by those skilled in the art that none of the devices presented by the prior art have resulted in an electrically-operated one-piece faucet which has a truly modular construction which allows components of the device other than a battery to be removed and replaced for service without requiring the complete disassembly, and potentially even the removal, of the device.

It is accordingly a primary objective of the present invention that it provide an electrically-operated faucet of compact one-piece construction which is entirely self-contained. It is another primary objective of the present invention that the electrically-operated faucet be of modular construction to make it easy to troubleshoot and to repair. It is a related objective of the present invention that it make the broadest possible use of modular components to thereby make all of the components which may typically be replaced over the life of the device easy to remove and replace without necessitating either the complete disassembly or removal of the device. It is another objective of the present invention that when the modules are accessed for removal and replacement the flow of water through the device is deactivated.

It is a further objective of the present invention that it be adaptable to operate with either a long-lasting battery or with a battery replacement module connected to an AC adapter. It is a still further objective of the present invention that it be configurable to alternatively allow users to adjust the temperature of water supplied from the device, or to allow only a technician to adjust the temperature of water supplied from the device, or to operate with only cold or with water of a premixed temperature supplied to the device. It is yet another objective of the present invention that it be configurable to allow either a conventional faucet spout or a gooseneck spout to be mounted thereupon.

It is another objective of the present invention that it be configurable to be either deck mountable or wall mountable. It is a related objective of the present invention that both the deck mount configuration and the wall mount configuration be easy to install. It is yet another related objective of the present invention that it provide substantially improved mounting hardware to make its installation even easier and quicker to accomplish.

The modular electrically-operated faucet of the present invention must also be of construction which is both durable and long lasting, and it should also be designed to require little or no maintenance to be provided by the user throughout its operating lifetime. In order to enhance the market appeal of the modular electrically-operated faucet of the present invention, it should also be of relatively inexpensive construction as compared to competing devices so as to thereby afford it the broadest possible market. Finally, it is also an objective that all of the aforesaid advantages and objectives of the modular electrically-operated faucet of the present invention be achieved without incurring any substantial relative disadvantage.

SUMMARY OF THE INVENTION

The disadvantages and limitations of the background art discussed above are overcome by the present invention. With this invention, a self-contained, modular electrically-operated faucet is provided which has a design which allows all of its components which are likely to need replacement over the life of the device contained in removable modules which may be quickly and easily removed and replaced without necessitating the removal of the device from its installed location. The modular electrically-operated faucet of the present invention has a number of basic configuration options, the most significant of which are its ability to be configured as either a deck mount faucet or a wall mount faucet, and its ability to be fitted with either a conventional faucet spout or with a gooseneck spout.

The modular electrically-operated faucet of the present invention is designed around a two-piece housing construction in which an upper housing member is mounted on top of a lower lousing member. The lower housing member accepts the water supply inlets, with either both hot and cold water supplies being accepted or alternately only a single cold water or water of a premixed temperature supply also being accepted. The lower housing also contains some water passages which are designed to supply water to the upper housing member.

The upper housing member contains a mixing valve chamber to allow hot and cold water to be mixed to provide water of a desired temperature makeup. Significantly, virtually all of the components of the modular electrically-operated faucet which are likely to need replacement over the life of the device are mounted on the top side of the upper housing member. A solenoid valve is screwed into the top of the upper housing member, and this construction, together with an electrical plug connecter to supply it with power, make the solenoid valve relatively easy to replace.

A sealed electronic module containing all of the electronics of the modular electrically-operated faucet, including the infrared signal source and detector, is also mounted on the top side of the upper housing member, and may be easily removed and replaced as a single module. The electronics module has a connector to supply power to the connector of the solenoid valve, and electrical connections which are removably installable in a two-piece battery bracket. The battery bracket is designed to accept either a replaceable long-lasting lithium CRP2 battery, or a battery adapter module having a wire extending through both the upper housing module and the lower housing module and leading to an AC adapter.

The modular electrically-operated faucet of the present invention has a shutoff magnet assembly which has a small magnet located in a housing at the distal end of a flexible lead, the proximal end of which is connected to a screw used to secure the housing of a faucet spout or the housing of a gooseneck spout on the upper and lower housing members. When the shutoff magnet assembly is in its installed position to help to secure the housing of a faucet spout or the housing of a gooseneck spout in place, the magnet is located adjacent a portion of the electronics module. When the magnet is not so located, the electronic module will not allow the solenoid valve to be actuated to allow water to be dispensed from the modular electrically-operated faucet.

Another option of the modular electrically-operated faucet of the present invention is the selection of mixing valve mechanisms installed in the mixing valve chamber in the upper housing module. Two alternate types of temperature adjustment mechanisms may be utilized with the modular electrically-operated faucet, with one being externally adjustable by the user of the device using a mixing valve lever, and the other being accessible only by technicians following removal of the housing of a faucet spout or the housing of a gooseneck spout. A third type of mechanism may instead be installed if only cold or with water of a premixed temperature are to be supplied to the modular electrically-operated faucet.

For a deck mount installation, the modular electrically-operated faucet of the present invention has two flexible water supply lines and a threaded mounting post extending from the bottom side of the lower housing member. A novel molded plastic mounting bracket is used to retain the modular electrically-operated faucet in position on a deck. The two flexible water supply lines fit through a large opening contained in the mounting bracket, and the threaded mounting post extends through an aperture contained in the mounting bracket in a light interference fit which will prevent the mounting bracket from slipping off of the threaded mounting post due to the force of gravity alone. An extended length mounting nut which is cylindrical with a threaded interior and a hex head located on the bottom end thereof may be screwed onto the threaded mounting post by hand until it is snugly engaging the mounting bracket, after which a wrench or a screwdriver may be used to tighten it up to retain the modular electrically-operated faucet in place.

It the modular electrically-operated faucet of the present invention is made in a wall-mount configuration, a different lower housing member is used in conjunction with a side mount adapter member which is mounted under the lower housing member. A side mount housing enclosed the side mount adapter member and the lower portion of the lower housing member, with two flexible water supply lines extending from the side of the side mount adapter and out of a cylindrical mounting member extending from the side of the side mount housing. The outer diameter of the cylindrical mounting member of the side mount housing is threaded to facilitate the mounting of the wall mountable version of the modular electrically-operated faucet in a wall.

It may therefore be seen that the present invention teaches an electrically-operated faucet of compact one-piece construction which is entirely self-contained. The modular electrically-operated faucet of the present invention that the electrically-operated operated faucet is of modular construction to make it easy to troubleshoot and to repair. The modular electrically-operated faucet of the present invention makes the broadest possible use of modular components to thereby make all of the components which may typically be replaced over the life of the device easy to remove and replace without necessitating either the complete disassembly or removal of the device. Advantageously, when the modules of the modular electrically-operated faucet of the present invention are accessed for removal and replacement, the flow of water through the device is deactivated.

The modular electrically-operated faucet of the present invention is adaptable to operate with either a long-lasting battery or with a battery replacement module connected to an AC adapter. The modular electrically-operated faucet of the present invention is also configurable to alternatively allow users to adjust the temperature of water supplied from the device, or to allow only a technician to adjust the temperature of water supplied from the device, or to operate with only cold or with water of a premixed temperature supplied to the device. The modular electrically-operated faucet of the present invention is configurable to allow either a conventional faucet spout or a gooseneck spout to be mounted thereupon.

The modular electrically-operated faucet of the present invention is also configurable to be either deck mountable or wall mountable, both of which configurations are easy to install. The modular electrically-operated faucet of the present invention also provides substantially improved mounting hardware to make its installation even easier and quicker to accomplish.

The modular electrically-operated faucet of the present invention is of a construction which is both durable and long lasting, and which is designed to require little or no maintenance to be provided by the user throughout its operating lifetime. The modular electrically-operated faucet of the present invention is also of relatively inexpensive construction as compared to competing devices so to enhance its market appeal and to thereby afford it the broadest possible market. Finally, all of the aforesaid advantages and objectives of the modular electrically-operated faucet of the present invention are achieved without incurring any substantial relative disadvantage.

DESCRIPTION OF THE DRAWINGS

These and other advantages of the present invention are best understood with reference to the drawings, in which:

FIG. 19 is an isometric view of a mixing barrel having a mixer coupling located at one thereof which components are used in the construction of the modular electrically-operated faucet of the present invention;

FIG. 20 is an end view of the mixer coupling mounted on the mixing barrel illustrated in FIG. 19;

FIG. 21 is a cross-sectional view of the mixing barrel and mixer coupling illustrated in FIGS. 19 and 20;

FIG. 22 is an isometric view of a limiter which will mount onto mixer coupling illustrated in FIGS. 19 through 21;

FIG. 23 is an end view of the limiter illustrated in FIG. 22 from a first end thereof;

FIG. 24 is an end view of the limiter illustrated in FIGS. 22 and 23 from a second end thereof;

FIG. 29 is an isometric view from the bottom and the side of a mounting bracket used to install the modular electrically-operated faucet of the present invention in a deck mount configuration;

FIG. 30 is a bottom plan view of the mounting bracket illustrated in FIG. 29;

FIG. 31 is a top plan view of the mounting bracket illustrated in FIGS. 29 and 30;

FIG. 45 is a isometric view of a mixing barrel having a screwdriver-engageable mixer drive member located at one thereof which components may be used in the construction of an alternate embodiment modular electrically-operated faucet, showing a pilot capscrew used to limit rotation of the mixing barrel by the mixer drive member in a first direction in phantom lines;

FIG. 46 is an isometric view of the mixing barrel and mixer drive member illustrated in FIG. 45, showing a pilot capscrew used to limit rotation of the mixing barrel by the mixer drive member in a second direction in phantom lines;

FIG. 47 is an end view of the mixer drive member mounted on the mixing barrel illustrated in FIGS. 45 and 46;

FIG. 48 is a side plan view of a view of a mixing plug which may be used in the construction of an alternate embodiment modular electrically-operated faucet having only a single water inlet with either cold water or water of a premixed temperature;

FIG. 49 is a side plan view of an inlet plug which may be used in conjunction with the mixing plug illustrated in FIG. 48 to block one of the inlets in the lower housing member illustrated in FIGS. 2 and 4;

FIG. 52 is a top plan view of a lower housing member used in the construction of an alternate embodiment wall mount modular electrically-operated faucet;

FIG. 53 is a bottom plan view of the lower housing member illustrated in FIG. 52;

FIG. 54 is a side view of the lower housing member illustrated in FIGS. 52 and 53;

FIG. 55 is a cross-sectional view of the lower housing member illustrated in FIGS. 52 through 54, showing water passages contained in the lower housing member;

FIG. 60 is a top plan view of a wall mount housing;

FIG. 61 is a cross-sectional view of the wall mount housing illustrated in FIG. 60;

DETAILED DESCRIPTION OF THE PREFERRED EMBODIMENT

Figure 1:
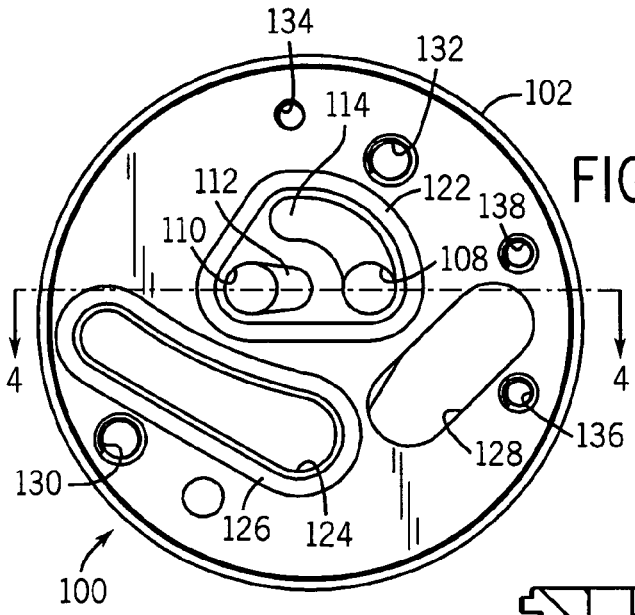
FIG. 1 is a top plan view of a lower housing member used in the construction of the modular electrically-operated faucet of the present invention.

The preferred embodiment on the modular electrically-operated faucet of the present invention will be discussed in a preferred embodiment which is deck mountable, which has a conventional faucet spout and user-adjustable water temperature, and is powered by a replaceable battery, with other configurations being described as well. FIGS. 1 through 34 show the various components of the modular electrically-operated faucet of the present invention, and FIGS. 35 through 40 show the assembly of these and other components into the modular electrically-operated faucet. FIGS. 41 through 44 show various aspects of the operation of the modular electrically-operated faucet of the present invention, and FIGS. 45 through 62 show various options and alternative constructions of the modular electrically-operated faucet of the present invention.

Referring first to FIGS. 1 through 4, a lower housing member 100 is illustrated which has short circular base 102 having a centrally-located three-sided mounting pillar 104 extending downwardly from the bottom side of the circular base 102. The circular base 102 has a U-shaped channel 106 located in the outer periphery thereof into which an O-ring (not shown in FIGS. 1 through 4) will be located. A hot water inlet 108 and a cold water inlet 110 both extend from the bottom side of the mounting pillar 104 to the top side of the circular base 102, with the hot water inlet 108 and the cold water inlet 110 both having a larger diameter in the mounting pillar 104 and stepping down to a smaller diameter in the circular base 102.

Figure 3:
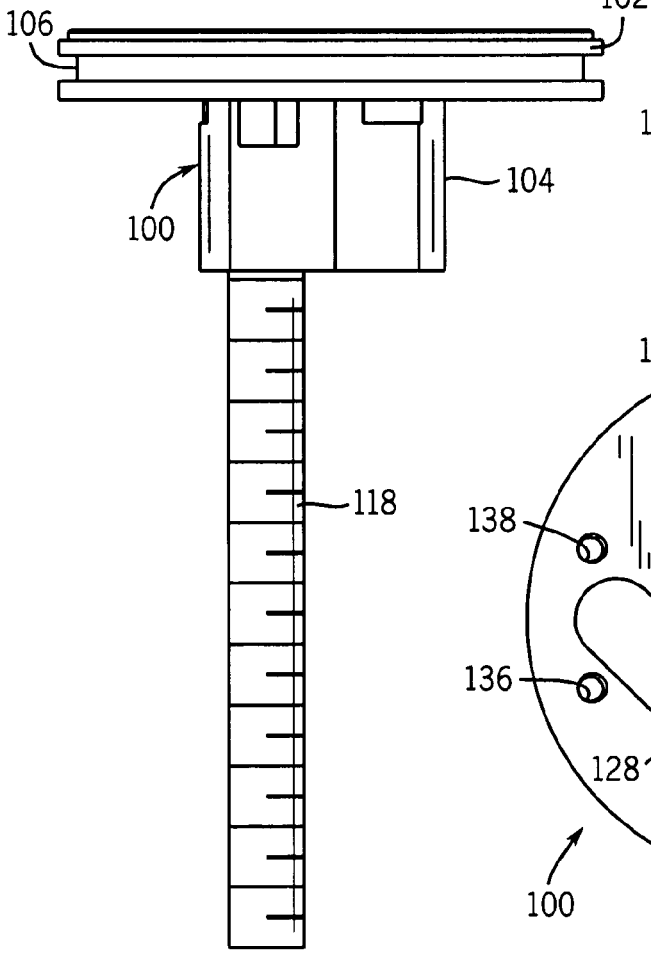
FIG. 3 is a side view of the lower housing member illustrated in FIGS. 1 and 2, also showing a mounting post which is screwed into the lower housing member.
Figure 2:
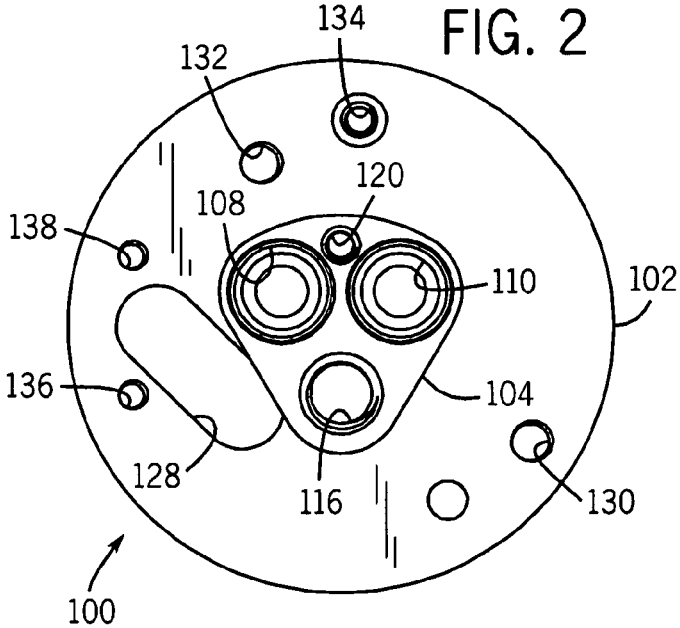
FIG. 2 is a bottom plan view of the lower housing member illustrated in FIG. 1.

Located in the top side of the circular base 102 and leading from the cold water inlet 110 toward the hot water inlet 108 is a recessed passageway 112. Also located in the top side of the circular base 102 and leading from the hot water inlet 108 and moving in a ninety degree counterclockwise arc is a recessed passageway 114. Located in the bottom side of the mounting pillar 104 as shown in FIG. 2 is a threaded aperture 116 into which one end of a threaded mounting post 118 is screwed in as shown in FIG. 3. Located in the bottom side of the mounting pillar 104 near the hot water inlet 108 and the cold water inlet 110 and near the side of the mounting pillar 104 furthest from the threaded aperture 116 is a threaded aperture 120.

Located in the top side of the circular base 102 and surrounding all of the hot water inlet 108, the cold water inlet 110, the passageway 112, and the passageway 114 is a recessed channel 122 into which a gasket (not shown in FIGS. 1 through 4) will be placed. Another recessed passageway 124 is also located in the top side of the circular base 102, and the recessed passageway 124 is surrounded by a recessed channel 126 into which a gasket (not shown in FIGS. 1 through 4) will be placed. Located in and extending through the circular base 102 is a slot 128 through which a wire for an external power source (not shown in FIGS. 1 through 4) may be threaded.

Extending through the circular base 102 at a location near the side of the recessed channel 126 furthest from the recessed channel 122 is a threaded aperture 130. Extending through the circular base 102 at a location near the side of the recessed channel 122 furthest from the recessed channel 126 is a threaded aperture 132. Extending through the circular base 102 at a location near the edge thereof and adjacent the furthest point of the passageway 114 from the hot water inlet 108 is a threaded aperture 134 which has a cylindrical countersink on the bottom side of the circular base 102. Completing the construction of the lower housing member 100 are two threaded apertures 136 and 138 located near the edge of the circular base 102 on opposite sides of the end of the slot 128 closest to the edge of the circular base 102.

Referring next to FIGS. 5 through 10, an upper housing member 150 is illustrated which is of a generally circular configuration with a side of the circle chopped off leaving a flat side 152. The circular configuration of the upper housing member 150 is of the same diameter as the circular configuration of the circular base 102 of the lower housing member 100 (shown in FIGS. 1 through 4). Extending upwardly from the top of the upper housing member 150 opposite the middle of the flat side 152 is a pillar 154 which terminates in a cylindrical segment 156 having a U-shaped channel 158 located in the outer periphery thereof into which an O-ring (not shown in FIGS. 5 through 10) will be located.

An aperture 160 extends from the bottom side of the upper housing member 150 and through the pillar 154 and the cylindrical segment 156. When the upper housing member 150 is mounted on the lower housing member 100 (shown in FIGS. 1 through 4), the aperture 160 will be in fluid communication with the recessed passageway 124 at the end nearest the side of the circular base 102. At the end of the aperture 160 on the bottom side of the upper housing member 150 is a tapered extension 162 of the aperture 160.

Located in the top side of the upper housing member 150 in one half thereof is a threaded aperture 164 which will be used to install a solenoid valve (not shown in FIGS. 5 through 10). The threaded aperture 164 extends approximately forty percent of the way from the top side of the upper housing member 150 to the bottom side of the upper housing member 150. Located concentrically in the bottom of the threaded aperture 164 is a cylindrical recess 166, which extends approximately ninety percent of the way from the top side of the upper housing member 150 to the bottom side of the upper housing member 150. The cylindrical recess 166 is of a smaller diameter than the threaded aperture 164.

Extending upwardly from the bottom of the cylindrical recess 166 concentrically therewith is a hollow cylindrical segment 168 which extends upwardly approximately two-thirds of the height of portion of the cylindrical recess 166 below the threaded aperture 164. The outer diameter of the cylindrical segment 168 is smaller than the inner diameter of the cylindrical recess 166, leaving a cylindrical space therebetween. An aperture 170 extends from the bottom side of the upper housing member 150 into the cylindrical recess 166, with the aperture 170 being concentric with the upwardly extending cylindrical segment 168. When the upper housing member 150 is mounted on the lower housing member 100 (shown in FIGS. 1 through 4), the aperture 170 will be in fluid communication with the recessed passageway 124 at the end closest to the slot 128.

A cylindrical aperture 172 is located in side of the upper housing member 150 furthest from the cylindrical recess 166 and extends toward the cylindrical recess 166 approximately thirty percent of the way from the side of the upper housing member 150 to the cylindrical recess 166. A slightly smaller cylindrical aperture 174 is concentrically located at the bottom of the aperture 170 and extends approximately ninety percent of the way from the side of the upper housing member 150 to the cylindrical recess 166. A still smaller cylindrical aperture 176 is concentrically located at the bottom of the aperture 174 and extends from the end of the aperture 174 into the cylindrical recess 166.

Located in the bottom of the upper housing member 150 and extending upwardly into the aperture 174 at the bottommost side thereof are apertures 178 and 180, which are spaced apart. The aperture 178 is located closer to the aperture 172 than is the aperture 180, and the aperture 180 is located closed to the aperture 176 than is the aperture 178. When the upper housing member 150 is mounted on the lower housing member 100 (shown in FIGS. 1 through 4), the aperture 178 will be in fluid communication with the passageway 114 at the end furthest from the hot water inlet 108, and the aperture 180 will be in fluid communication with the end of the passageway 112 furthest from the cold water inlet 110. An aperture 182 is located in the bottom of the upper housing member 150 and extends upwardly into the aperture 172 at the bottommost side thereof near (but not at) the end thereof.

An aperture 184 which extends through the upper housing member 150 is located near the edge of the upper housing member 150 at a location between the pillar 154 and the threaded aperture 164. An aperture 186 which extends through the upper housing member 150 is located near the edge of the upper housing member 150 at a location between the flat side 152 and the aperture 172. The aperture 186 has a cylindrical countersink on the top side of the upper housing member 150. When the upper housing member 150 is mounted on the lower housing member 100 (shown in FIGS.

1 through 4), the aperture 184 will be aligned with the threaded aperture 130 and the aperture 186 will be aligned with the threaded aperture 132.

Extending from the flat side 152 at the top side of the upper housing member 150 near the aperture 186 is a support arm 188, which has a threaded aperture 190 extending therethrough. Located in the top side of the upper housing member 150 near the edge thereof on the side of the pillar 154 opposite the aperture 184 is a threaded aperture 192.

Figure 5:
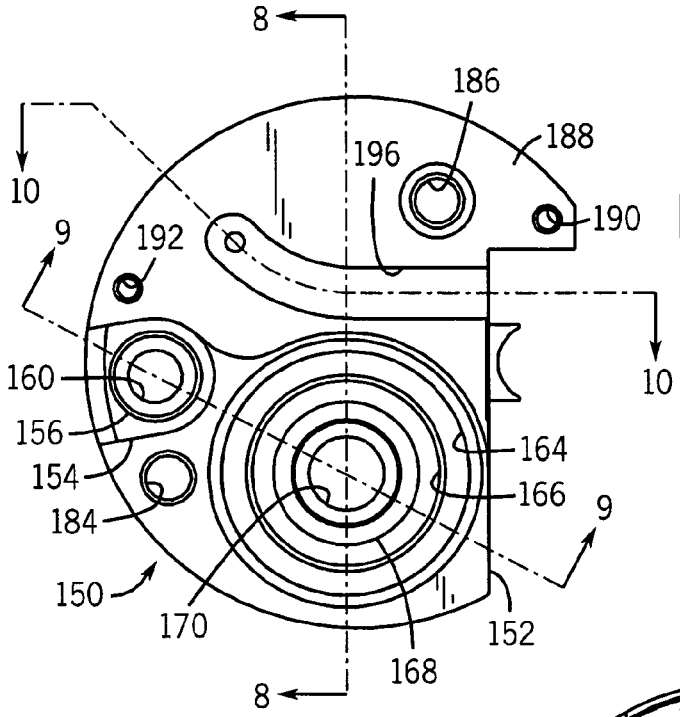
FIG. 5 is a top plan view of an upper housing member which will be mounted on top of the lower housing member illustrated in FIGS. 1 through 4.
Figure 6:
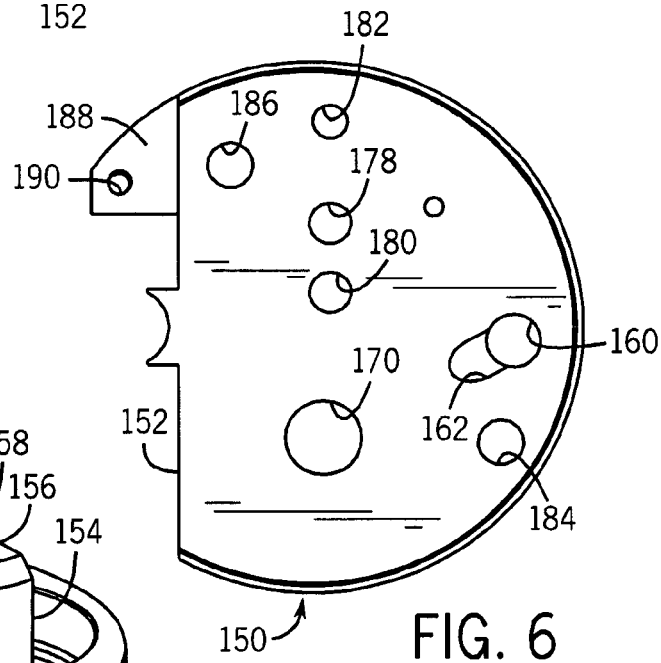
FIG. 6 is a bottom plan view of the upper housing member illustrated in FIG. 5.
Figure 7:
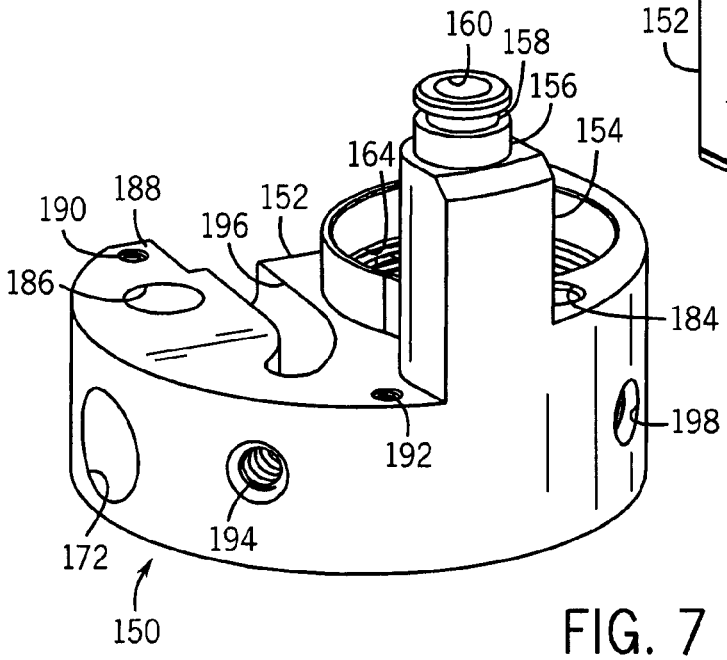
FIG. 7 is an isometric view of upper housing member illustrated in FIGS. 5 and 6.
Figure 10:
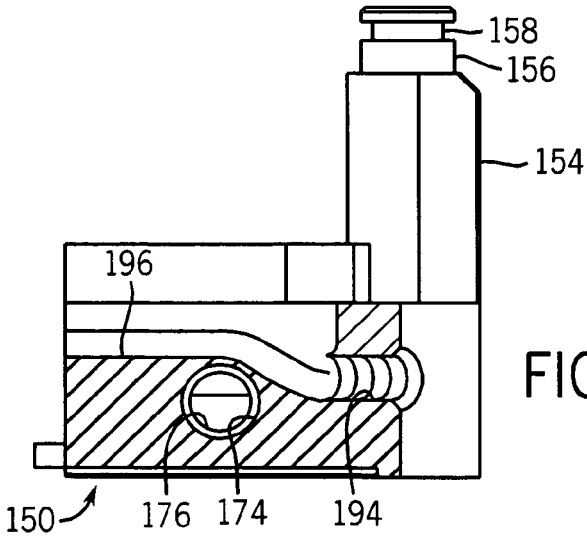
FIG. 10 is a third cross-sectional view of the upper housing member illustrated in FIGS. 5 through 9, showing an access passageway contained in the upper housing member.

Located in the side of the upper housing member 150 at a location intermediate the aperture 172 and the threaded aperture 192 and extending inwardly into the side of the upper housing member 150 is a threaded aperture 194. Located in the upper housing member 150 is a passageway 196 which extends from the flat side 152 toward the threaded aperture 192, with the passageway 196 curving and moving downwardly toward the threaded aperture 194 as best shown in FIGS. 5, 7, and 10. The passageway 196 is open on the top side of the upper housing member 150 from the flat side 152 until the passageway 196 begins to move downwardly to intersect with the threaded aperture 194. Completing the construction of the upper housing member 150 is another threaded aperture 198 which extends inwardly into the side of the upper housing member 150 on the side of the aperture 184 opposite the pillar 154. Note that the inclusion of this threaded aperture 198 is optional.

Figure 11:
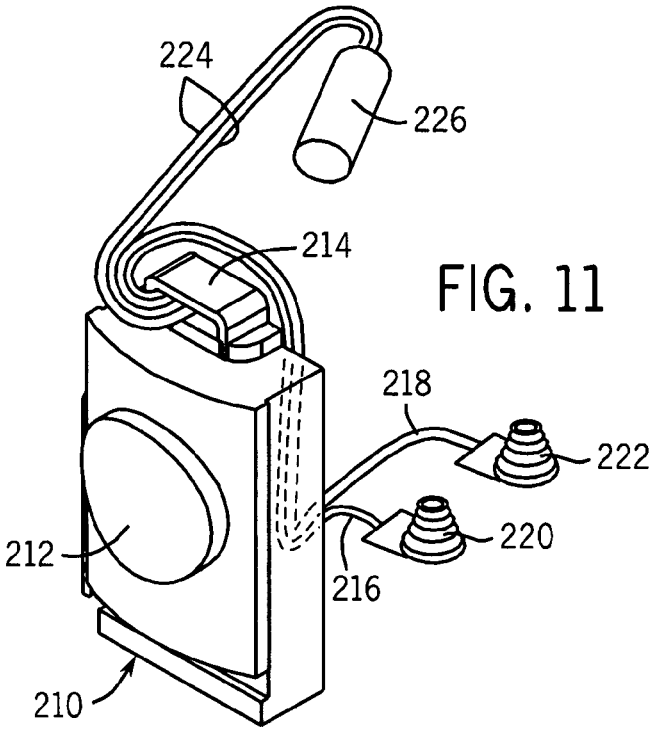
FIG. 11 is an isometric view of an electronics module used in the construction of the modular electrically-operated faucet of the present invention from the front side thereof.
Figure 12:
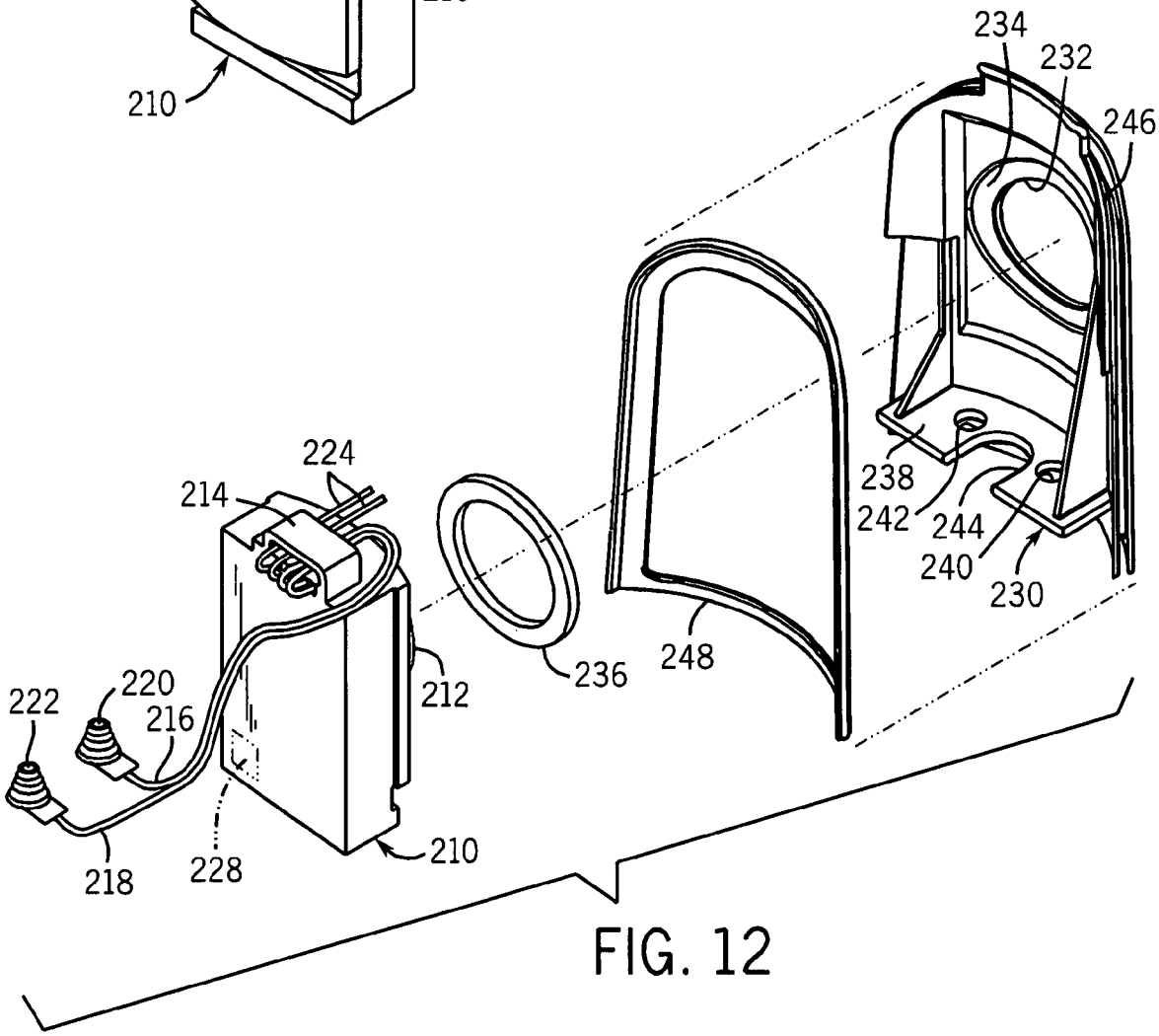
FIG. 12 is an exploded isometric view showing the electronics module illustrated in FIG. 11 from the back side, and also showing a front window and gaskets which are used to protect the electronics assembly.

Referring next to FIGS. 11 and 12, an electronics module 210 is illustrated. The electronics module 210 is a completely sealed unit, and when installed into the modular electrically-operated faucet of the present invention only an cylindrical sensor window 212 (which has an optical signal source and an optical signal sensor, which will be described in more detail below) will be exposed. The cylindrical sensor window 212 on the front side of the electronics module 210 extends slightly outwardly therefrom, as best shown in FIG. 11. The electronics module 210 has a number of wires extending from the back side thereof at a location near the top thereof, which wires extend through a strain relief 214 located on the top of the electronics module 210. Two of the wires 216 and 218 from the electronics module 210 are respectively connected to helical spring battery contacts 220 and 222, respectively. Two additional wires identified collectively with the reference numeral 224 are connected to a connector 226, and these wires 224 will supply power to a solenoid valve (not shown in FIGS. 11 and 12).

Located in the back side of the electronics module 210 near the bottom and on the left is a magnetic field detector 228 which is shown in phantom lines. When the electronics module 210 is installed in the modular electrically-operated faucet of the present invention, the back side of the magnetic field detector 228 will abut the flat side 152 of the upper housing member 150, with the magnetic field detector 228 being located proximate the end of the passageway 196 located at the flat side 152 (best shown in FIGS. 5 and 7).

The electronics module 210 will be installed in a front window housing member 230 having a sensor aperture 232 located therein. The cylindrical sensor window 212 of the electronics module 210 will be located in the sensor aperture 232 of the front window housing member 230 when the electronics module 210 is installed in the front window housing member 230. Located in the inside surface of the front window housing member 230 and surrounding the sensor aperture 232 is an annular recess 234 into which an electronic module mounting gasket 236 will be placed to seal between the outer periphery of the cylindrical sensor window 212 and the front window housing member 230.

Extending inwardly from the front window housing member 230 near the bottom thereof is a base 238 upon which the electronics module 210 will rest when it is installed in the front window housing member 230. Located in the base 238 are two apertures 240 and 242 which will be used to mount the front window housing member 230 in the modular electrically-operated faucet of the present invention. The apertures 240 and 242 will be aligned with the threaded apertures 136 and 138 in the lower housing member 100 (best shown in FIG. 1) when the front window housing member 230 is mounted on the modular electrically-operated faucet. Located in the base 238 intermediate the apertures 240 and 242 is a notch 244 which will be aligned with a portion of the slot 128 in the lower housing member 100.

Located around the outer periphery of the front window housing member 230 is a seal mounting edge indicated generally by the reference numeral 246. A front gasket 248 will fit into the seal mounting edge 246 of the front window housing member 230, and will be used to seal around the outer periphery of the front window housing member 230.

Figure 13:
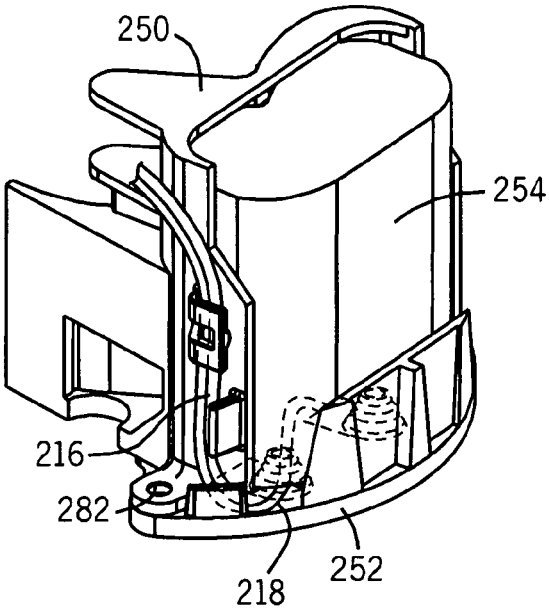
FIG. 13 is a exploded isometric view of a battery bracket used in the construction of the modular electrically-operated faucet of the present invention together with a battery.
Figure 14:
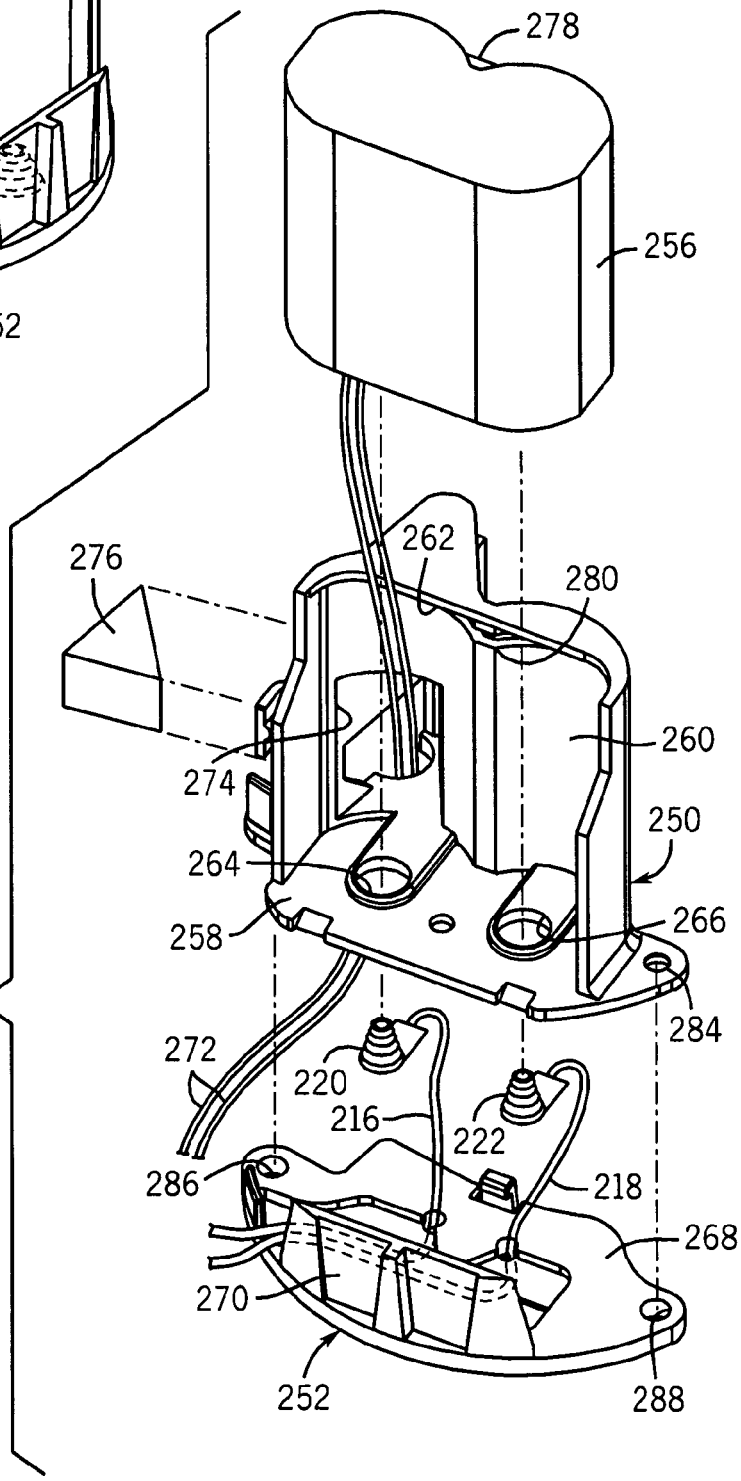
FIG. 14 is an isometric view of the battery bracket illustrated in FIG. 13 from the back side thereof, showing battery adapter and a strain relief member.

Referring next to FIGS. 13 and 14, a two-piece battery bracket consisting of an upper battery bracket 250 and a lower battery bracket 252 is shown. In FIG. 13, the battery bracket is shown assembled and with a replaceable CRP2 lithium battery 254 installed, and in FIG. 14 the battery bracket is shown in exploded fashion with a battery adapter 256. The upper battery bracket 250 has a flat base 258 with side walls 260 adapted to fit the contours of the sides and rear of the replaceable CRP2 lithium battery 254 when they are installed in the battery bracket. The upper battery bracket 250 has a lip 262 located at its top which will engage the top side of the replaceable CRP2 lithium battery 254 at the rear edges thereof when the replaceable CRP2 lithium battery 254 is installed in the upper battery bracket 250.

The upper battery bracket 250 has two apertures 264 and 266 located in the flat base 258 of the upper battery bracket 250. The tips of the spring battery contacts 220 and 222 extend upwardly through the apertures 264 and 266, respectively, where they may make contact with contacts (not shown) on the replaceable CRP2 lithium battery 254 or the battery adapter 256. The lower battery bracket 252 consists of a flat base 268 having a front wall 270 projecting upwardly from the front edge of the lower battery bracket 252. The front wall 270 of the lower battery bracket 252 will retain the front edge of the replaceable CRP2 lithium battery 254 or the battery adapter 256 in place when they are installed in the battery bracket. The base 268 of the lower battery bracket 252 will retain the spring battery contacts 220 and 222 in their installed position in the battery bracket.

The battery adapter 256 has wires identified collectively with the reference numeral 272 extending therefrom. The wires 272 extend from the front of the battery adapter 256 near the bottom thereof, and will be routed through an aperture 274 located in the side walls 260 of the upper battery bracket 250, with a strain relief member 276 being placed in the wires 272 to grip the wires 272 and prevent them from being pulled from the battery adapter 256. The wires 272 will extend through the slot 128 in the lower housing member 100 (best shown in FIG. 1).

Located at the top of the battery adapter 256 at the center of the rear side thereof is an outwardly-extending ledge 278. Located in the side walls 260 of the upper battery bracket 250 at the center and near to but below the lip 262 of the upper battery bracket 250 is a notch 280 which will engage the outwardly-extending ledge 278 on the battery adapter 256 when the battery adapter 256 is installed in the battery bracket. When the battery adapter 256 is installed in the battery bracket, the top side of the battery adapter 256 will be spaced away from the lip 262 in the upper battery bracket 250.

Located in the flat base 258 of the upper battery bracket 250 on opposite sides thereof are two apertures 282 and 284. Located in the base 268 of the lower battery bracket 252 on opposite sides thereof are two corresponding apertures 286 and 288. When the battery bracket is installed in the modular electrically-operated faucet of the present invention, apertures 282 and 284 in the upper battery bracket 250 will be respectively aligned with apertures 286 and 288 in the lower battery bracket 252, and with the apertures 190 and 192 in the upper housing member 150 (best shown in FIGS. 5 and 7).

Figure 15:
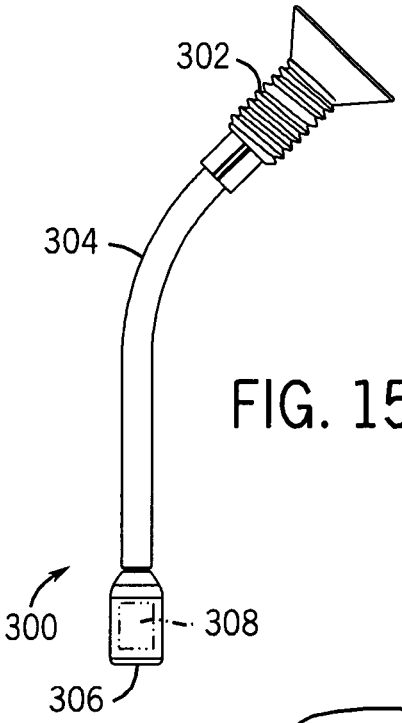
FIG. 15 is an isometric view of a shutoff magnet assembly, with a magnet shown in phantom lines within a housing at the end of a lead opposite a screw.

Referring now to FIG. 15, a shutoff magnet assembly 300 is illustrated which has a screw 302 located at one end thereof. One end of a flexible lead 304 is fixedly attached to the distal end of the screw 302, and the opposite end of the flexible lead 304 is fixedly attached to a small housing 306 containing a magnet 308 therein (the magnet is shown with phantom lines). When the shutoff magnet assembly 300 is installed in the modular electrically-operated faucet of the present invention, it will extend into the threaded aperture 194 and through the passageway 196 in the upper housing member 150 (best shown in FIGS. 5 and 7), with the housing 306 and the magnet 308 being located in proximity to the magnetic field detector 228 of the electronics module 210 (best shown in FIG. 12).

Figure 16:
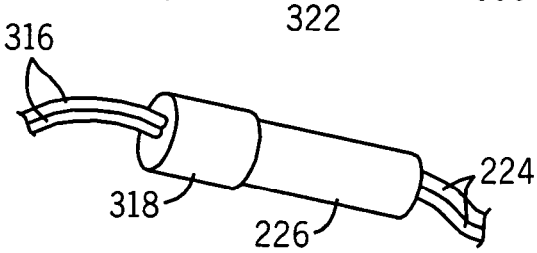
FIG. 16 is an isometric view of a solenoid valve with the valve element shown in its fully extended position, and with the retracted position of the valve element being shown in phantom lines.
Figure 16:
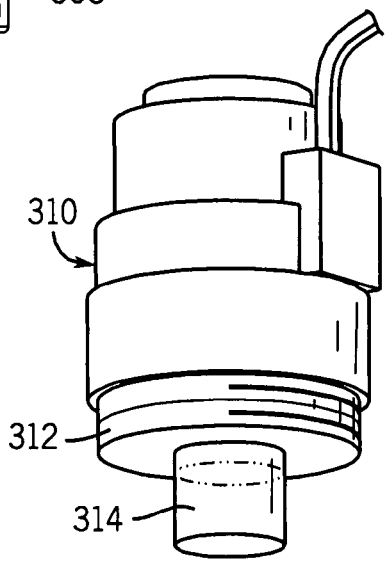

Referring next to FIG. 16, a solenoid valve 310 is illustrated which has a threaded cylindrical base 312 having a cylindrical solenoid plunger 314 extending therefrom. Two wires identified collectively with the reference numeral 316 extend from the solenoid valve 310 and are connected to a connector 318. The connector 318 will be plugged into the connector 226 to supply power to the solenoid valve 310 from the electronics module 210 (best shown in FIG. 11). When the solenoid valve 310 is not powered, the solenoid plunger 314 will extend fully out of the solenoid valve 310 as shown, and when the solenoid valve 310 is powered, the solenoid plunger 314 will be retracted to the position shown in phantom lines.

Figure 17:
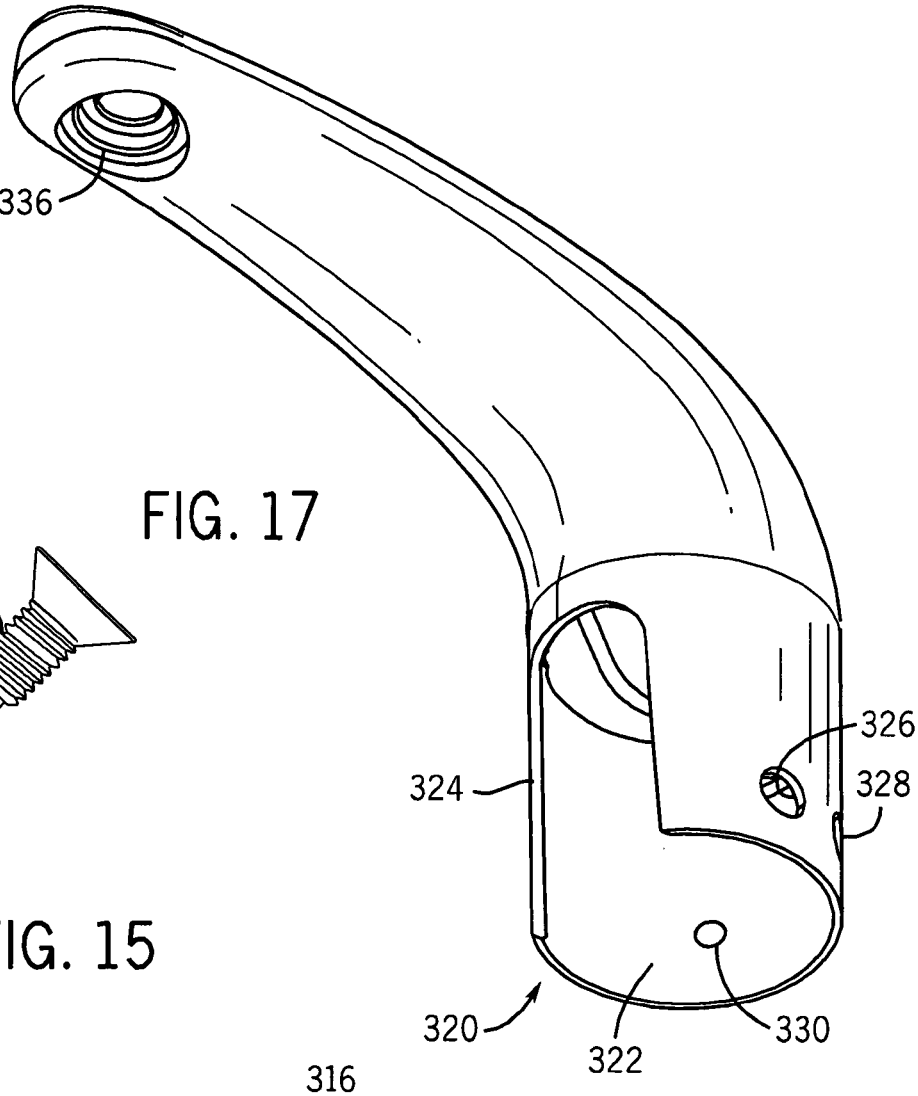
FIG. 17 is an isometric view of a faucet spout used in the construction of the modular electrically-operated faucet of the present invention.
Figure 18:
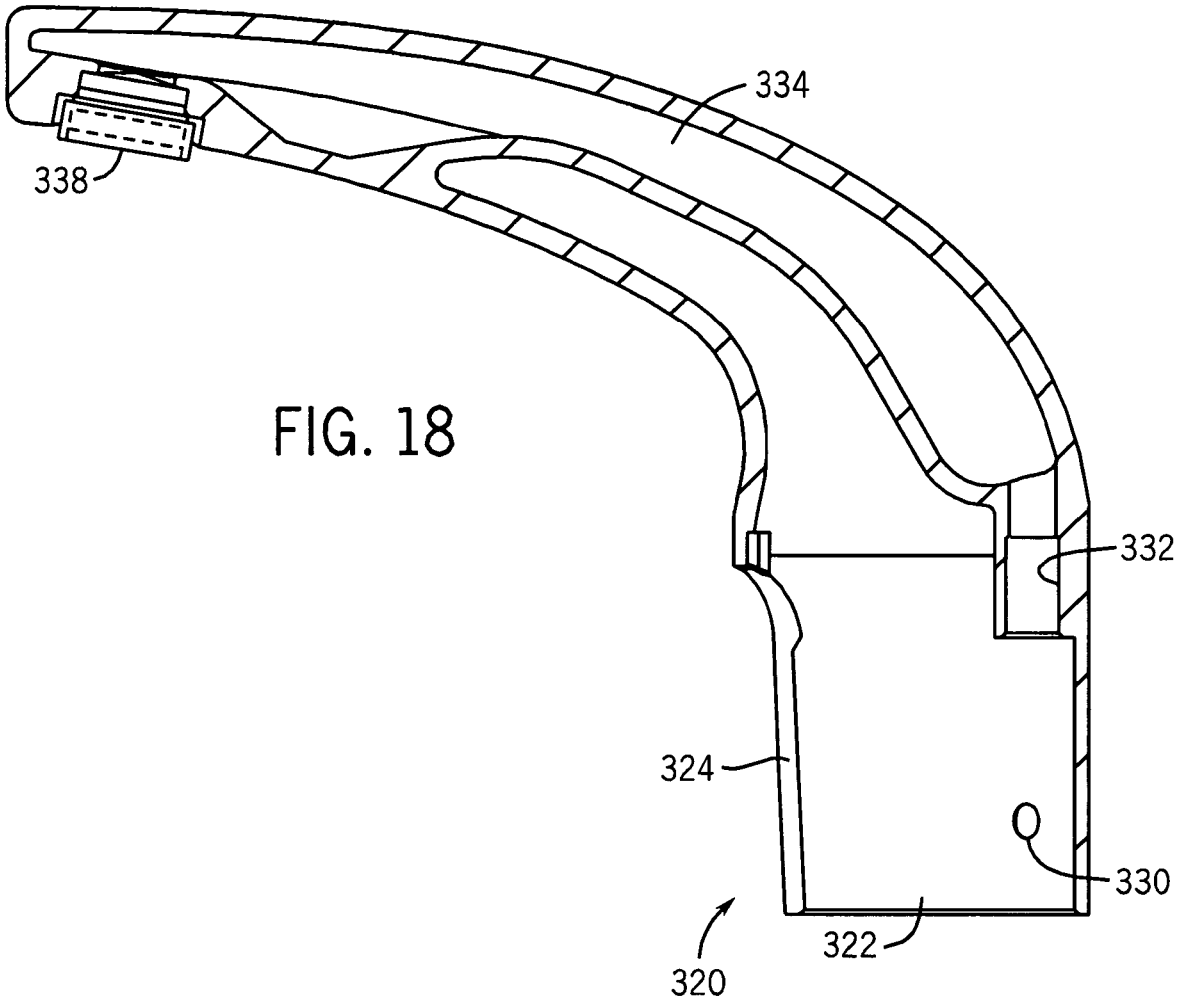
FIG. 18 is a cross-sectional view of the faucet spout illustrated in FIG. 17.

Referring now to FIGS. 17 and 18, a faucet spout 320 is shown which has a hollow cylindrical base 322 having a notch 324 cut out at the front thereof to accommodate the front window housing member 230 (shown in FIG. 12) therein. The cylindrical base 322 of the faucet spout 320 has a larger valve aperture 326 located on one side of the cylindrical base 322 near the bottom thereof, and two smaller countersunk apertures 328 and 330 which are spaced apart and are located on the rear side of the cylindrical base 322 thereof near the bottom thereof. Note that the inclusion of the countersunk aperture 330 is optional. When the faucet spout 320 is installed onto the modular electrically-operated faucet of the present invention, the bottom of the cylindrical base 322 will fit over both the upper housing member 150 and the lower housing member 100, with the apertures 328 and 330 being respectively aligned with the threaded apertures 194 and 198 in the upper housing member 150 (best shown in FIG. 7).

Located within the cylindrical base 322 near the top thereof and at the back of the faucet spout 320 is a cylindrical aperture 332 which communicates with a passageway 334 running to the front of the spout and terminating at the location of a threaded aperture 336. An aerator 338 is screwed into the threaded aperture 336. When the faucet spout 320 is installed on the modular electrically-operated faucet of the present invention, the cylindrical aperture 332 will fit over the cylindrical segment 156 extending from the pillar 154 in the upper housing member 150 (best shown in FIG. 7).

Referring next to FIGS. 19 through 21, a mixing barrel 350 having a mixer coupling 352 located at one thereof is shown. The mixing barrel 350 is a hollow cylindrical, with the end of the mixing barrel 350 which is connected to the mixer coupling 352 being closed and the other end of the mixing barrel 350 being open. The mixing barrel 350 has a two triangular openings located therein, with a hot water valve opening 354 being located closer to the end of the mixing barrel 350 which is connected to the mixer coupling 352 than it is to the open end of the mixing barrel 350, and a cold water valve opening 356 being located closer to the open end of the mixing barrel 350 than it is to the end of the mixing barrel 350 which is connected to the mixer coupling 352.

Figure 8:
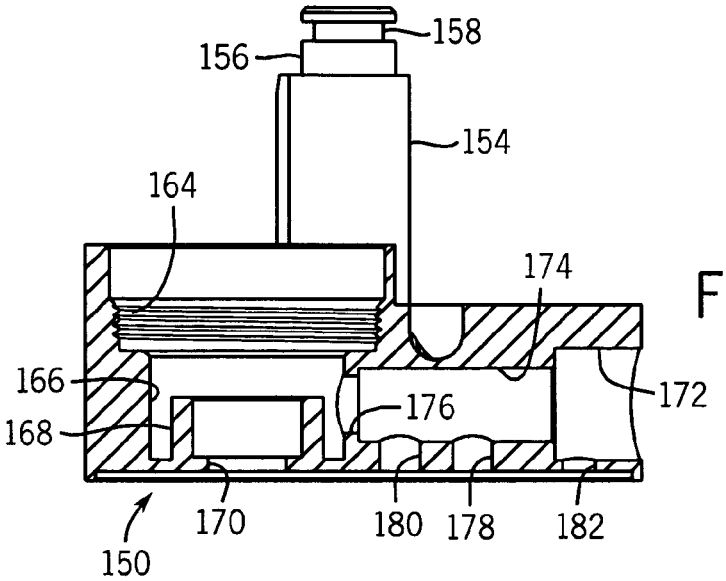
FIG. 8 is a first cross-sectional view of the upper housing member illustrated in FIGS. 5 through 7, showing water passages contained in the upper housing member.
Figure 9:
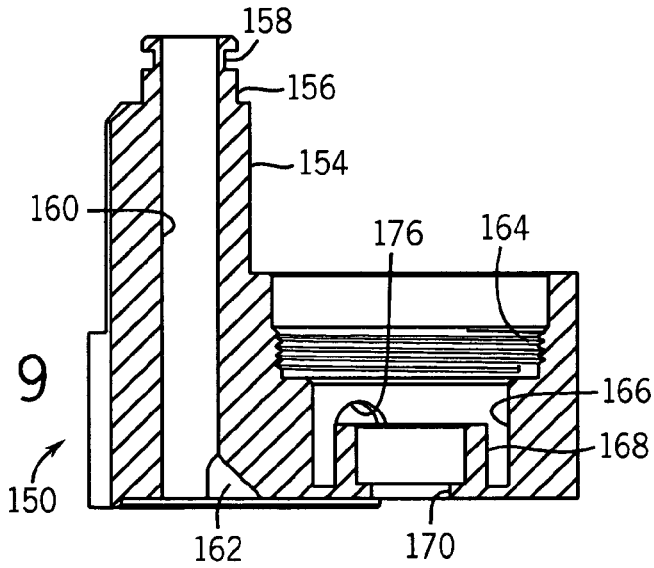
FIG. 9 is a second cross-sectional view of the upper housing member illustrated in FIGS. 5 through 8, showing additional water passages contained in the upper housing member.

The narrow end of the hot water valve opening 354 is axially aligned with the wider end of the cold water valve opening 356, and the wider end of the hot water valve opening 354 is axially aligned with the narrower end of the cold water valve opening 356. Referring for the moment to FIG. 8 in addition to FIGS. 19 through 21, when the mixing barrel 350 is installed in the modular electrically-operated faucet of the present invention, it will be located in the aperture 174 in the upper housing member 150, with the mixer coupling 352 being located in the aperture 172.

Hot water will flow through the aperture 178 in the upper housing member 150 and the cold water valve opening 356 in the mixing barrel 350, through the interior of the mixing barrel 350, and through the aperture 176 in the upper housing member 150. Similarly, cold water will flow through the aperture 180 in the upper housing member 150 and the cold water valve opening 356 in the mixing barrel 350, through the interior of the mixing barrel 350, and through the aperture 176 in the upper housing member 150. By rotating the mixing barrel 350, the mix of hot and cold water can be adjusted.

The mixer coupling 352 has an annular U-shaped channel 358 into which an O-ring 360 is located to prevent water from flowing out of the aperture 174 into the aperture 172 in the upper housing member 150. The mixer coupling 352 has a circular flange 362 centrally located therein which will fit into the aperture 172 in the upper housing member 150. Located at the end of the mixer coupling 352 opposite the mixing barrel 350 is a cylindrical end 364 having a flat face 366 located therein, and having a threaded aperture 368 located therein.

Referring now to FIGS. 22 through 24, a limiter 380 is shown which will fit onto the cylindrical end 364 of the mixer coupling 352 (shown in FIGS. 19 through 21). The limiter 380 is cylindrical with an aperture 382 extending therethrough, with the aperture 382 having an cross-sectional configuration which is circular with a flat side to match the configuration of the cylindrical end 364 of the mixer coupling 352 having the flat face 366. Thus, either end of the limiter 380 may be placed onto the cylindrical end 364 of the mixer coupling 352.

The limiter 380 has notches 384 and 386 located at opposite ends thereof, with the notches 384 and 386 being aligned as best shown in FIG. 22. The limiter 380 also has arcuate notches 388 and 390 cut into the ends thereof, with the arcuate notch 388 being located at the same end as the notch 384, and the arcuate notch 390 being located at the same end as the notch 386. Referring now to FIG. 23, if the notch 384 is indexed at twelve o'clock, the arcuate notch 388 extends from before three o'clock to after nine o'clock. Referring now to FIG. 24, if the notch 386 is indexed at twelve o'clock, the arcuate notch 390 extends from before three o'clock to after eight o'clock.

The notches 384 and 386 will serve to drive rotation of the limiter 380 and thus also the mixing barrel 350, which has the mixer coupling 352 to which it is connected engaged by the limiter 380. When the limiter 380 is mounted onto the cylindrical end 364 of the mixer coupling 352, the one of the notches 384 and 386 in the limiter 380 which is oriented away from the mixer coupling 352 will serve to drive the limiter 380, the mixer coupling 352, and the mixing barrel 350. The one of the arcuate notches 388 and 390 which is oriented toward the mixer coupling 352 will serve to limit the rotational movement of the limiter 380, the mixer coupling 352, and the mixing barrel 350. If the arcuate notch 388 is oriented toward the mixer coupling 352, the adjustment allowed will be between 100% cold water to 100% hot water, and if the limiter 380 is oriented toward the mixer coupling 352, the adjustment allowed will be between 80% cold water to 100% hot water.

Figure 25:
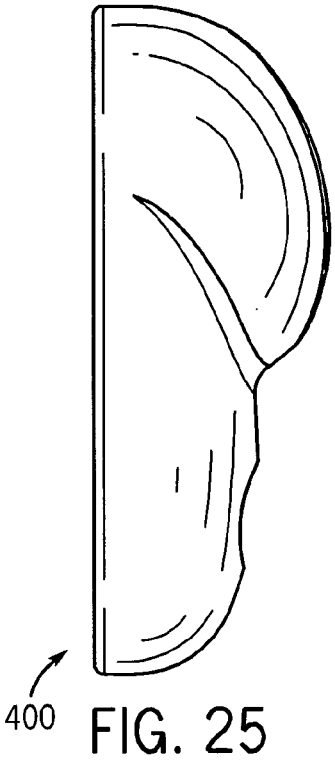
FIG. 25 is a side plan view of a mixer handle lever which will mount onto the limiter illustrated in FIGS. 22 through 24.
Figure 26:
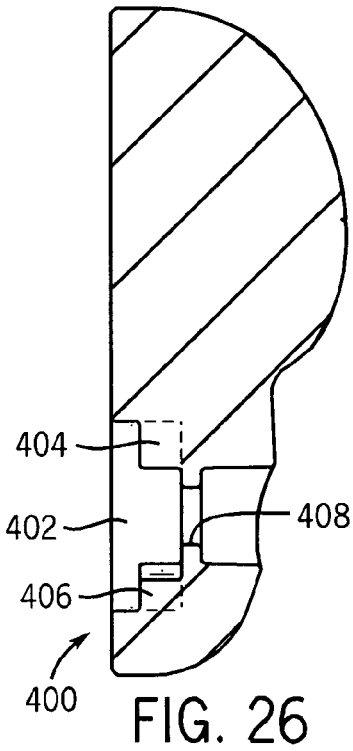
FIG. 26 is a cross-sectional view of the mixer handle lever illustrated in FIG. 25.
Figure 27:
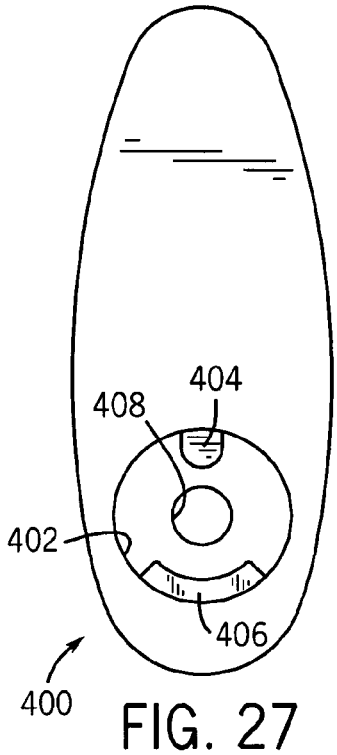
FIG. 27 is an inside plan view of the mixer handle lever illustrated in FIGS. 25 and 26.

Referring next to FIGS. 25 through 27, a mixer handle lever 400 which will be mounted on the end of the limiter 380 (shown in FIGS. 22 through 24) which is not attached to the mixer coupling 352 (best shown in FIG. 19) is shown. The mixer handle lever 400 has a recess 402 located in one side thereof and near one end thereof. The recess 402 is essentially cylindrical, but has a tab 404 projecting into the recess 402 at the side of the recess 402 toward the opposite end of the mixer handle lever 400, and an arcuate tab 406 extending over an approximately ninety degree arc on the side of the recess 402 opposite the arcuate tab 406. Thus, the recess 402 will drivingly receive either end of the limiter 380, with the tab 404 fitting into the one of the notches 384 and 386 which is on the end of the limiter 380 inserted into the mixer handle lever 400. A recessed aperture 408 extends from the opposite side of the recess 402 in the mixer handle lever 400, and communicates with the recess 402.

Figure 28:
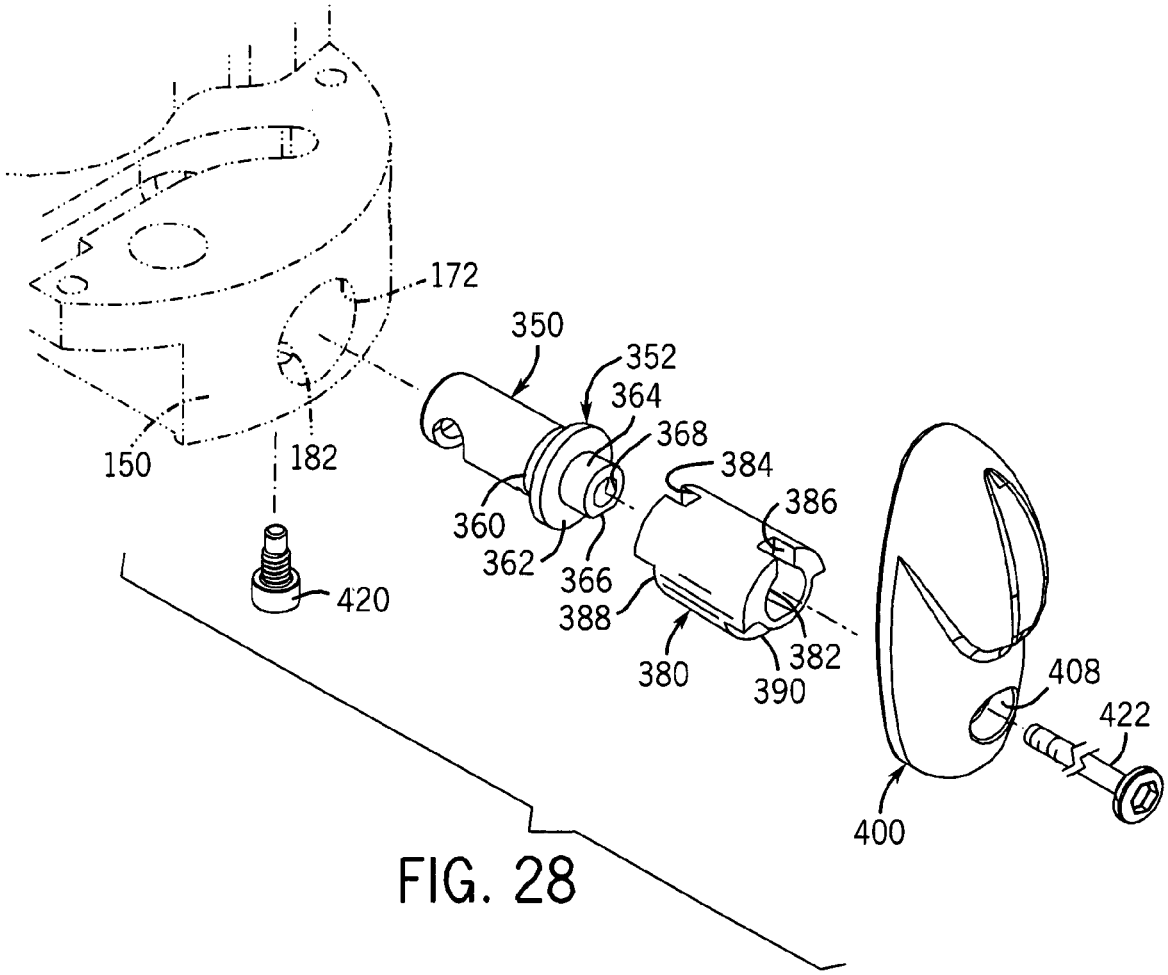
FIG. 28 is an exploded isometric view showing the assembly of the mixer handle lever illustrated in FIGS. 25 through 27, the limiter illustrated in FIGS. 22 through 24, the mixing barrel and mixer coupling shown in FIGS. 19 through 21, and an O-ring into the upper housing member illustrated in FIGS. 5 through 10, where they are retained by a capscrew and a pilot capscrew.

Referring now to FIG. 28 in conjunction with FIGS. 19 through 27 and also to the upper housing member 150 as shown in FIG. 8, the assembly of the mixing valve members into the upper housing member 150 is illustrated. A pilot capscrew 420 will extend through the aperture 182 in the upper housing member 150 into the aperture 172 in the upper housing member 150. The distal tip of this pilot capscrew 420 will serve to engage the side of the circular flange 362 of the mixer coupling 352 opposite the mixing barrel 350, thereby retaining the mixing barrel 350 in place in the aperture 174 in the upper housing member 150. Additionally, the pilot capscrew 420 will also serve to limit the rotation of the limiter 380 and thus the mixer coupling 352 and the mixing barrel 350, since the distal tip of the pilot capscrew 420 will engage the arcuate notch 388 in the limiter 380.

A capscrew 422 extends through the recessed aperture 408 in the mixer handle lever 400, through the aperture 382 in the limiter 380, and into the threaded aperture 368 in the mixer coupling 352. Thus, it will be appreciated that by rotating the mixer handle lever 400, the water temperature mix may be adjusted.

Referring next to FIGS. 29 through 32, a highly innovative mounting bracket 430 for use with the modular electrically-operated faucet of the present invention is illustrated. The mounting bracket 430, which may be molded of a plastic material, will be used to retain the modular electrically-operated faucet in position in a deck mount configuration. The threaded mounting post 118 (which is mounted on the lower housing member 100 as best shown in FIG. 3 and is shown in phantom lines in FIG. 31) and a flexible hot water supply tube 432 and a cold water supply tube 434 (both shown in phantom lines in FIG. 31) extend from the bottom of the modular electrically-operated faucet and through the mounting bracket 430.

The mounting bracket 430 has an annular base 436 which has a flat side 438 (which will typically be oriented toward the back side of a sink on which the modular electrically-operated faucet is being mounted). Extending downwardly from the inside edge of the annular base 436 over approximately 270 degrees thereof is a frustroconical segment 440 which tapers in diameter from a larger diameter at the top adjacent the annular base 436 to a smaller diameter at the point furthest from the annular base 436. Extending outwardly from the open side edges of the frustroconical segment 440 are two support fins 442 and 444 which are parallel and which extend nearly to the outer edge of the annular base 436.

A roughly semicircular bottom surface 446 extends from the bottommost edges of the frustroconical segment 440, with the flat side of the bottom surface 446 extending between the ends of the support fins 442 and 444. A hollow cylindrical support tube 448 extends from the bottom surface 446 upwardly approximately half of the way toward the plane of the annular base 436, and the support tube 448 is orthogonal with respect to the annular base 436. The support tube 448 has an aperture 450 extending all the way therethrough, with the aperture 450 also extending through the bottom surface 446 to which the support tube 448 is connected. The mounting bracket 430 will be mounted with the threaded mounting post 118 extending through the aperture 450 in the support tube 448, and the diameter of the aperture 450 in the support tube 448 is sized to present a light interference fit on the threaded mounting post 118.

The support tube 448 is supported from the frustroconical segment 440 by four web members 452, 454, 456, and 458. The web member 452 extends between the support tube 448 and the intersection of the support fin 442 and the frustroconical segment 440, and the web member 454 extends between the bottom surface 446 and the intersection of the support fin 444 and the frustroconical segment 440. The web member 456 extends between the support tube 448 and the frustroconical segment 440 at a location on the opposite side of the support tube 448 from the web member 454. Similarly, the web member 458 extends between the support tube 448 and the frustroconical segment 440 at a location on the opposite side of the support tube 448 from the web member 452. Extending downwardly from the inside edge of the annular base 436 over approximately the 90 degrees arc between the support fins 442 and 444 is a short reinforcing segment 460.

Figure 33:
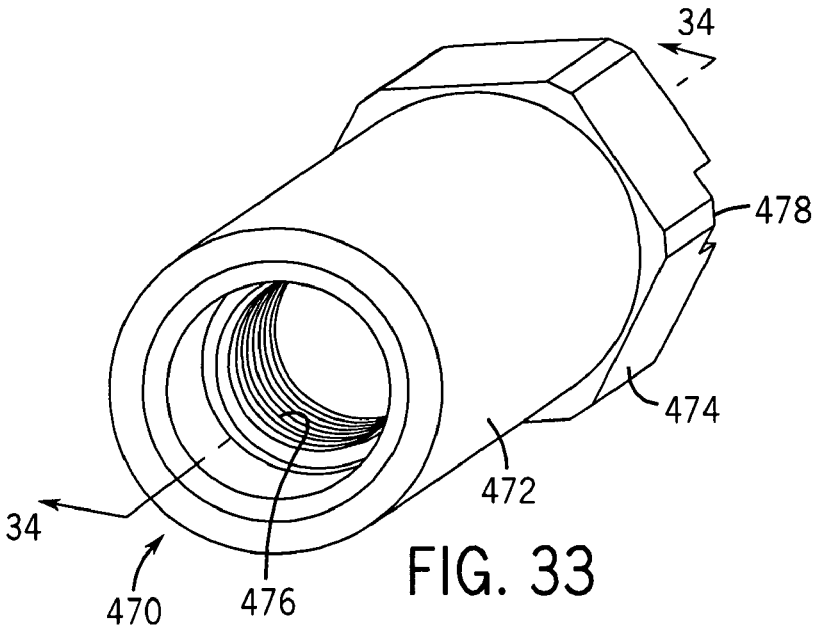
FIG. 33 is an isometric view from the top and the side of an extended length mounting nut which will be used to retain the mounting bracket illustrated in FIGS. 29 through 32 on the mounting post on the lower housing member illustrated in FIG. 3.
Figure 34:
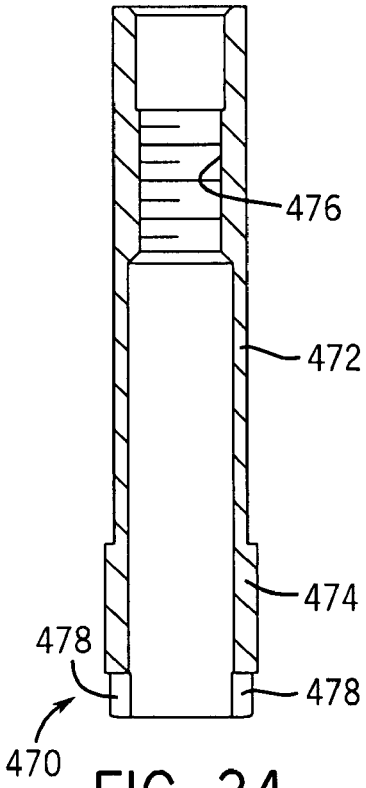
FIG. 34 is a cross-sectional view of the extended length mounting nut illustrated in FIG. 33.

Referring now to FIGS. 33 and 34, an extended length mounting nut 470 is illustrated which consists of a long, hollow cylindrical segment 472 having a hollow hex head segment 474 at one end thereof. The cylindrical segment 472 has an internally threaded portion 476 located near to, but not at, the end of the cylindrical segment 472 opposite the hex head segment 474. The internally threaded portion 476 approximately to the midpoint of the cylindrical segment 472, although if desired it may extend further toward the hex head segment 474. The end of the hex head segment 474 furthest from the cylindrical segment 472 is notched as indicated by the reference numerals 478 to allow the extended length mounting nut 470 to be rotated using a large flat-bladed screwdriver (not shown).

The assembly of the modular electrically-operated faucet of the present invention is illustrated in the exploded view of FIG. 35 and the assembled views of FIGS. 36 through 39, and will be described with reference to FIGS. 1 through 34, which depict the various parts of the modular electrically-operated faucet. An inlet gasket 490 is placed into the recessed channel 122 in the lower housing member 100 (as best shown in FIG. 1), and a solenoid gasket 492 is placed into the recessed channel 126 in the lower housing member 100 (also best shown in FIG. 1). The upper housing member 150 is placed on top of the lower housing member 100, and a capscrew 494 is inserted through the aperture 184 in the upper housing member 150 (best shown in FIG. 5) and screwed into the threaded aperture 130 in the lower housing member 100 (again best shown in FIG. 1). A capscrew 496 is inserted through the aperture 186 in the upper housing member 150 (also best shown in FIG. 5) and screwed into the threaded aperture 132 in the lower housing member 100 (once again best shown in FIG. 1).

The front window housing member 230 is mounted onto the lower housing member 100 by inserting two screws 498 and 500 respectively through the apertures 240 and 242 (best shown in FIG. 12), and screwing the screws 498 and 500 into the threaded apertures 136 and 138 in the lower housing member 100 (best shown in FIG. 1). The solenoid valve 310 is then installed on the upper housing member 150 by screwing the threaded cylindrical base 312 of the solenoid valve 310 (best shown in FIG. 16) into the threaded aperture 164 in the upper housing member 150 (best shown in FIG. 5). The electronics module 210 is installed into the front window housing member 230, with the electronic module mounting gasket 236 mounted over the cylindrical sensor window 212 and in the annular recess 234 in the front window housing member 230. The connector 318 from the solenoid valve 310 is than connected to the connector 226 from the electronics module 210.

The tips of the spring battery contacts 220 and 222 are inserted through the apertures 264 and 266 in the upper battery bracket 250, and the lower battery bracket 252 is placed underneath the upper battery bracket 250 to retain the spring battery contacts 220 and 222 in place (all best shown in FIG. 14).

If the battery adapter 256 (shown in FIG. 14) is to be used rather than the replaceable CRP2 lithium battery 254, at this point the wires 272 from the battery adapter 256 would be fed through the aperture 274 in the upper battery bracket 250, and the battery adapter 256 would be placed loosely into the upper battery bracket 250. At this point, the outwardly-extending ledge 278 on the battery adapter 256 would not yet be placed into the notch 280 in the upper battery bracket 250. The strain relief member 276 would be installed into the aperture 274 in the upper battery bracket 250 to retain the wires 272 from the battery adapter 256. The wires 272 from the battery adapter 256 would be fed through the slot 128 in the lower housing member 100.

Two screws 502 and 504 are respectively inserted through the apertures 282 and 284 in the upper battery bracket 250 (again best shown in FIG. 14), then respectively through the apertures 286 and 288 in the lower battery bracket 252 (yet again best shown in FIG. 14), and are then respectively screwed into the threaded apertures 190 and 192 in the upper housing member 150 (best shown in FIG. 7).

A check valve 506 is placed into the hot water inlet 108 in the lower housing member 100 (best shown in FIG. 2), and a check valve 508 is placed into the cold water inlet 110 in the lower housing member 100 (again best shown in FIG. 2). A check valve 510 is placed into the aperture 160 in the cylindrical segment 156 on the pillar 154 on the upper housing member 150 (best shown in FIG. 7). Note that the check valves 506, 508, and 510 may be check valves from Neoperl, Inc. An O-ring 512 is placed into the U-shaped channel 158 in the cylindrical segment 156 on the pillar 154 on the upper housing member 150.

An O-ring 514 is placed into the U-shaped channel 106 in the circular base 102 of the lower housing member 100 (best shown in FIG. 3). The front gasket 248 is place into the seal mounting edge 246 in the front window housing member 230 (best shown in FIG. 12). The replaceable CRP2 lithium battery 254 is placed into position in the upper battery bracket 250. (Alternately, if the battery adapter 256 is instead being used, the battery adapter 256 is seated in the upper battery bracket 250 by placing the outwardly-extending ledge 278 of the battery adapter 256 into the notch 280 of the upper battery bracket 250 (best shown in FIG. 14).)

The faucet spout 320 may then be installed by placing it in position with the cylindrical segment 156 on the pillar 154 on the upper housing member 150 (best shown in FIG. 7) fitting into the cylindrical aperture 332 of the countersunk aperture 330 (best shown in FIG. 18). The notch 324 of the faucet spout 320 fits over the front window housing member 230, with the front gasket 248 sealing between the faucet spout 320 and the front window housing member 230. The lower portion of the cylindrical base 322 of the faucet spout 320 fits over the circular base 102 of the lower housing member 100, with the O-ring 514 sealing between the cylindrical base 322 of the faucet spout 320 and the circular base 102 of the lower housing member 100.

A screw 516 is then inserted through the countersunk aperture 330 in the cylindrical base 322 of the faucet spout 320 (best shown in FIGS. 17 and 18) and is screwed into the threaded aperture 198 in the upper housing member 150 (best shown in FIG. 7). Note that the inclusion of the screw 516 is optional, and is only done if the countersunk aperture 330 in the cylindrical base 322 of the faucet spout 320 and the threaded aperture 198 in the upper housing member 150 are present. The shutoff magnet assembly 300 may then be installed by inserting the end with the housing 306 and the magnet 308 through the countersunk aperture 328 in the cylindrical base 322 of the faucet spout 320, through the threaded aperture 194 and into the passageway 196 in the upper housing member 150 (best shown in FIGS. 7 and 10). By advancing the shutoff magnet assembly 300, eventually the screw 302 will be screwed into the threaded aperture 198 in the upper housing member 150. At this point, the housing 306 and the magnet 308 of the shutoff magnet assembly 300 will be located adjacent the magnetic field detector 228 of the electronics module 210 (best shown in FIG. 12).

The O-ring 360 is placed in the U-shaped channel 358 of the mixer coupling 352, and the mixing barrel 350 and the mixer coupling 352 are assembled to the limiter 380 and the mixer handle lever 400 using the capscrew 422. Note that the limiter 380 must be placed in the proper orientation to obtain either a full range of water temperatures (100% cold water to 100% hot water), or a limited range of water temperatures (100% cold to 80% hot). The mixing valve assembly is then assembled to the modular electrically-operated faucet, with the mixing barrel 350 and the mixer coupling 352 being inserted into the aperture 172 in the upper housing member 150 (best shown in FIG. 8) and the mixing barrel 350 being fully inserted into the aperture 174 in the upper housing member 150 (again best shown in FIG. 8).

When installed, the circular flange 362 of the mixer coupling 352 is located at the wall between the aperture 172 and the aperture 174. The pilot capscrew 420 is then screwed into the threaded aperture 134 in the lower housing member 100 (best shown in FIGS. 1 and 2), with the distal tip of the pilot capscrew 420 extending through the aperture 182 in the upper housing member 150 (best shown in FIG. 8). The distal tip of the pilot capscrew 420 will engage the circular flange 362 of the mixer coupling 352 (best shown in FIG. 19), thereby retaining the mixing barrel 350 and the mixer coupling 352 in place. Further, the distal tip of the pilot capscrew 420 cooperates with the arcuate notch 388 or the arcuate notch 390 (depending on the orientation of the limiter 380) to restrict the rotational movement of the mixing valve assembly.

Figure 40:
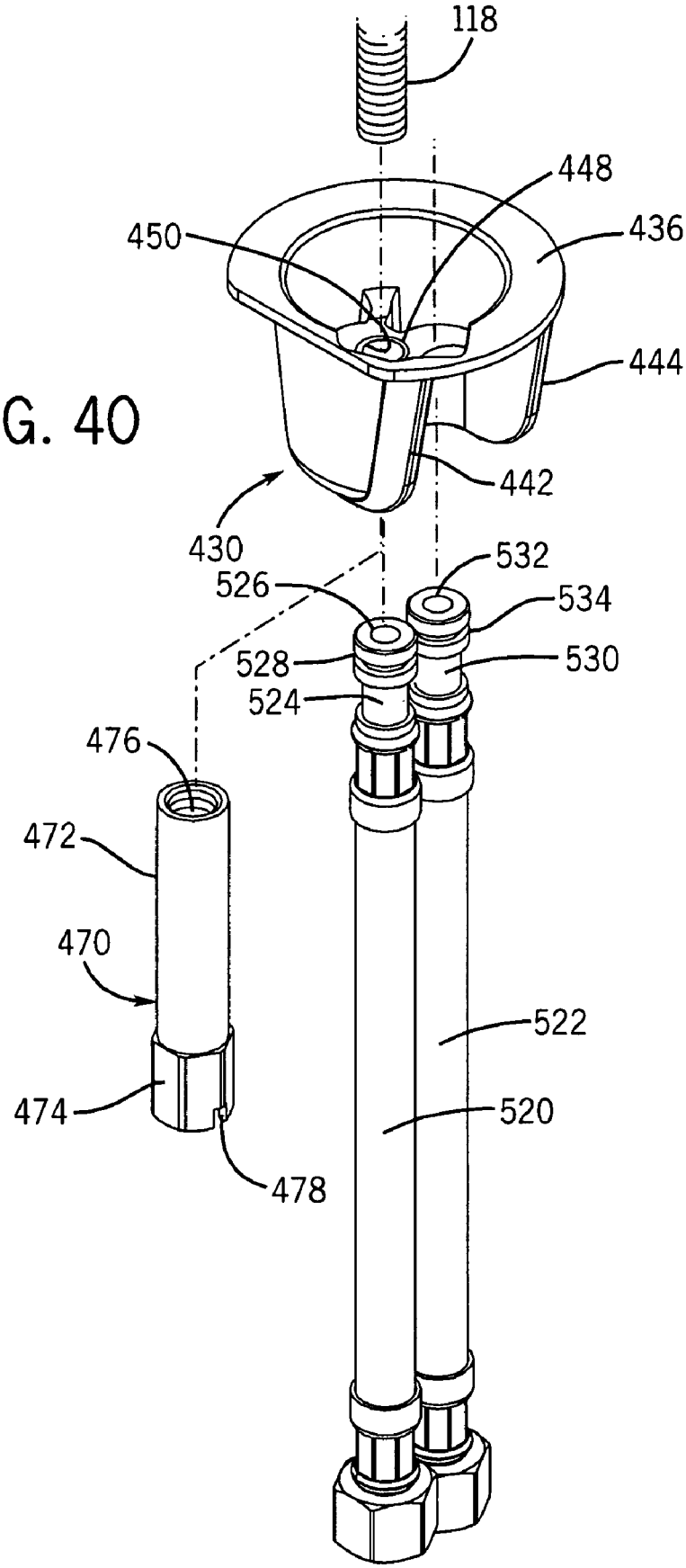
FIG. 40 is an enlarged exploded isometric view showing the components of the modular electrically-operated faucet of the present invention shown in FIG. 35 which will be used to mount the modular electrically-operated faucet in a deck mount configuration.

The threaded mounting post 118 is installed by screwing it into the threaded aperture 116 in the lower housing member 100 (best shown in FIGS. 2 and 3). Referring now to FIG. 40 in addition to FIG. 35 and other figures as referenced herein, two flexible supply tubes 520 and 522 are used to supply hot and cold water from water supplies (not shown) to the modular electrically-operated faucet. The flexible supply tube 520 has a water inlet adapter 524 having an enlarged head 526 with a U-shaped channel 528 located in the outer periphery of the enlarged head 526 of the water inlet adapter 524. The flexible supply tube 522 has a water inlet adapter 530 having an enlarged head 532 with a U-shaped channel 534 located in the outer periphery of the enlarged head 532 of the water inlet adapter 530.

Two O-rings 536 and 538 are respectively placed into the U-shaped channels 528 and 534. The enlarged head 528 of the water inlet adapter 524 is inserted into the hot water inlet 108 in the lower housing member 100 (best shown in FIG. 2), and the enlarged head 532 of the water inlet adapter 530 is inserted into the cold water inlet 110 in the lower housing member 100 (also best shown in FIG. 2). A screw 540 is then screwed into the threaded aperture 120 in the lower housing member 100 (again best shown in FIG. 2). The head of the screw 540 covers a portion of the enlarged heads 526 and 532 of the water inlet adapters 524 and 528, respectively, retaining them in place.

The modular electrically-operated faucet of the present invention may then be mounted onto a sink and/or in a deck. A deck washer 538 is placed over the flexible supply tubes 520 and 522 and the threaded mounting post 118 so that the deck washer 538 is located beneath the circular base 102 of the lower housing member 100 (best shown in FIG. 3). The flexible supply tubes 520 and 522 and the threaded mounting post 118 are then fed through a hole in a sink or a deck (not shown herein).

From beneath the sink or deck, the flexible supply tubes 520 and 522 are threaded through the annular base 436 and between the support fins 442 and 444 of the mounting bracket 430, and the support tube 448 of the mounting bracket 430 is placed over the threaded mounting post 118 so that the threaded mounting post 118 extends through the aperture 450 in the support tube 448. Since there is a slight interference fit of the support tube 448 of the mounting bracket 430 on the threaded mounting post 118, it will stay in place. The extended length mounting nut 470 is then screwed onto the threaded mounting post 118 to retain the modular electrically-operated faucet of the present invention in place.

Figure 41:
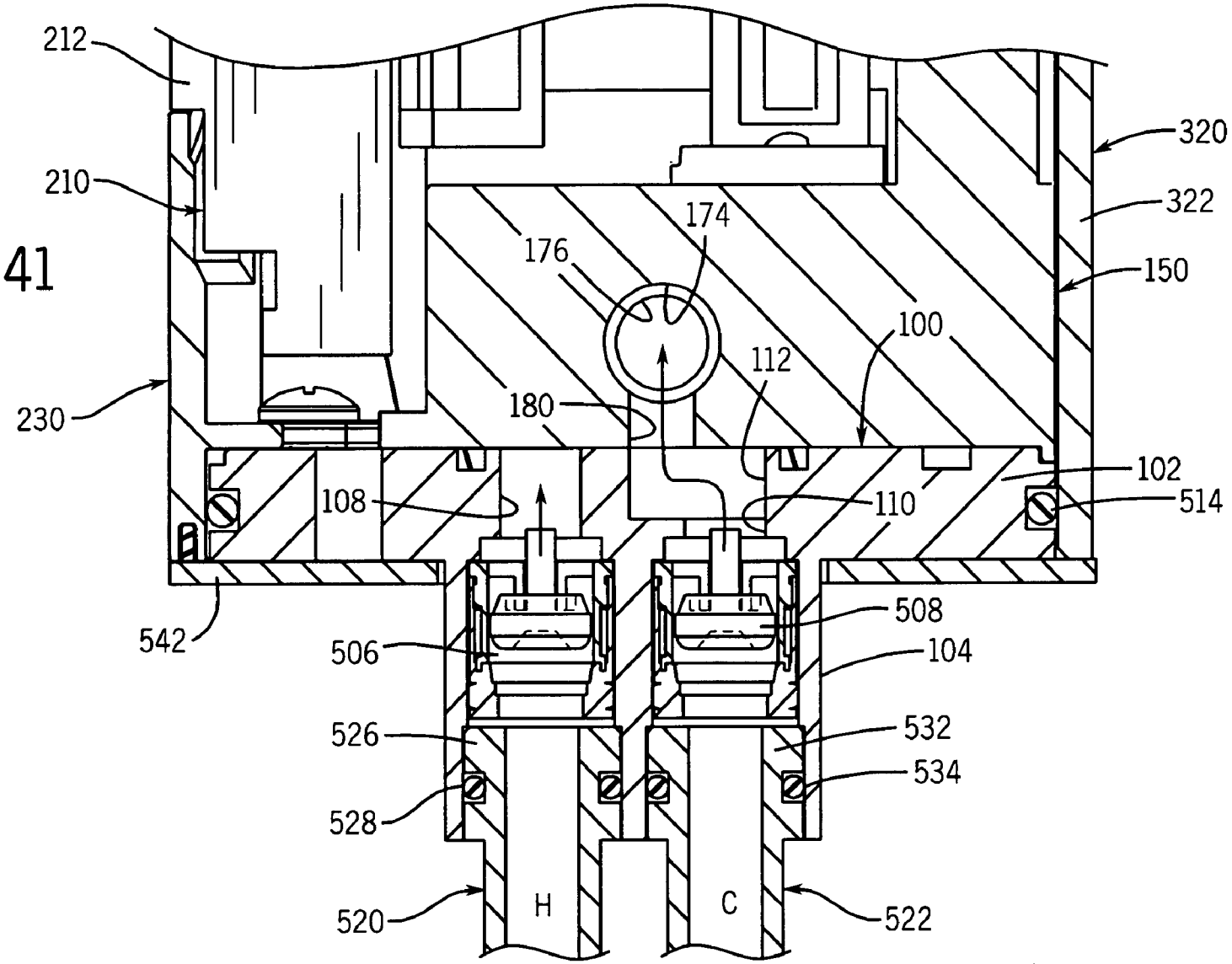
FIG. 41 is a first cross-sectional view of selected components of the assembled modular electrically-operated faucet of the present invention, showing the flow of water through passages in said the upper and lower housing members.
Figure 42:
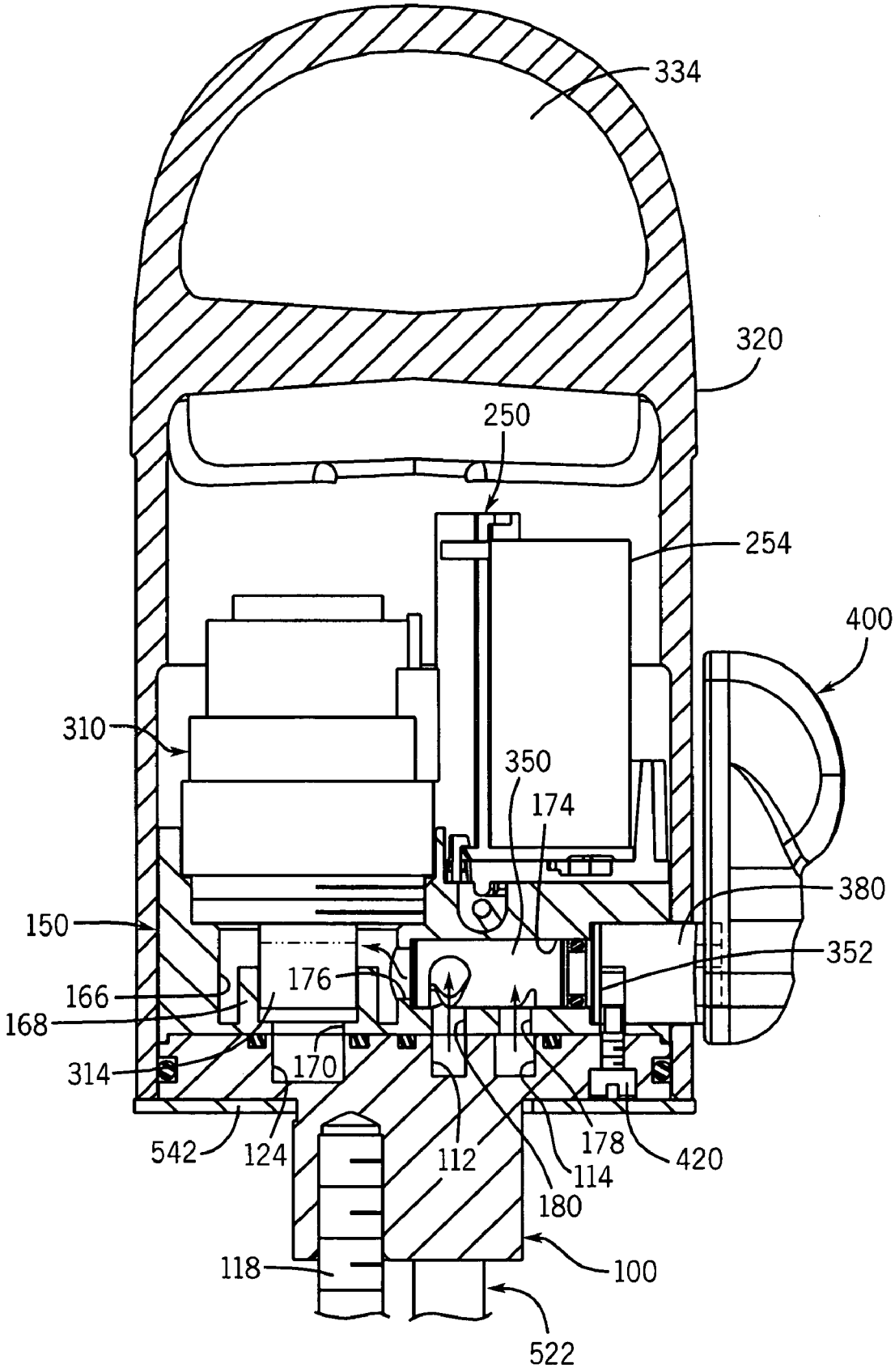
FIG. 42 is a second cross-sectional view of selected components of the assembled modular electrically-operated faucet of the present invention, showing the flow of water through passages in said the upper and lower housing members.
Figure 43:
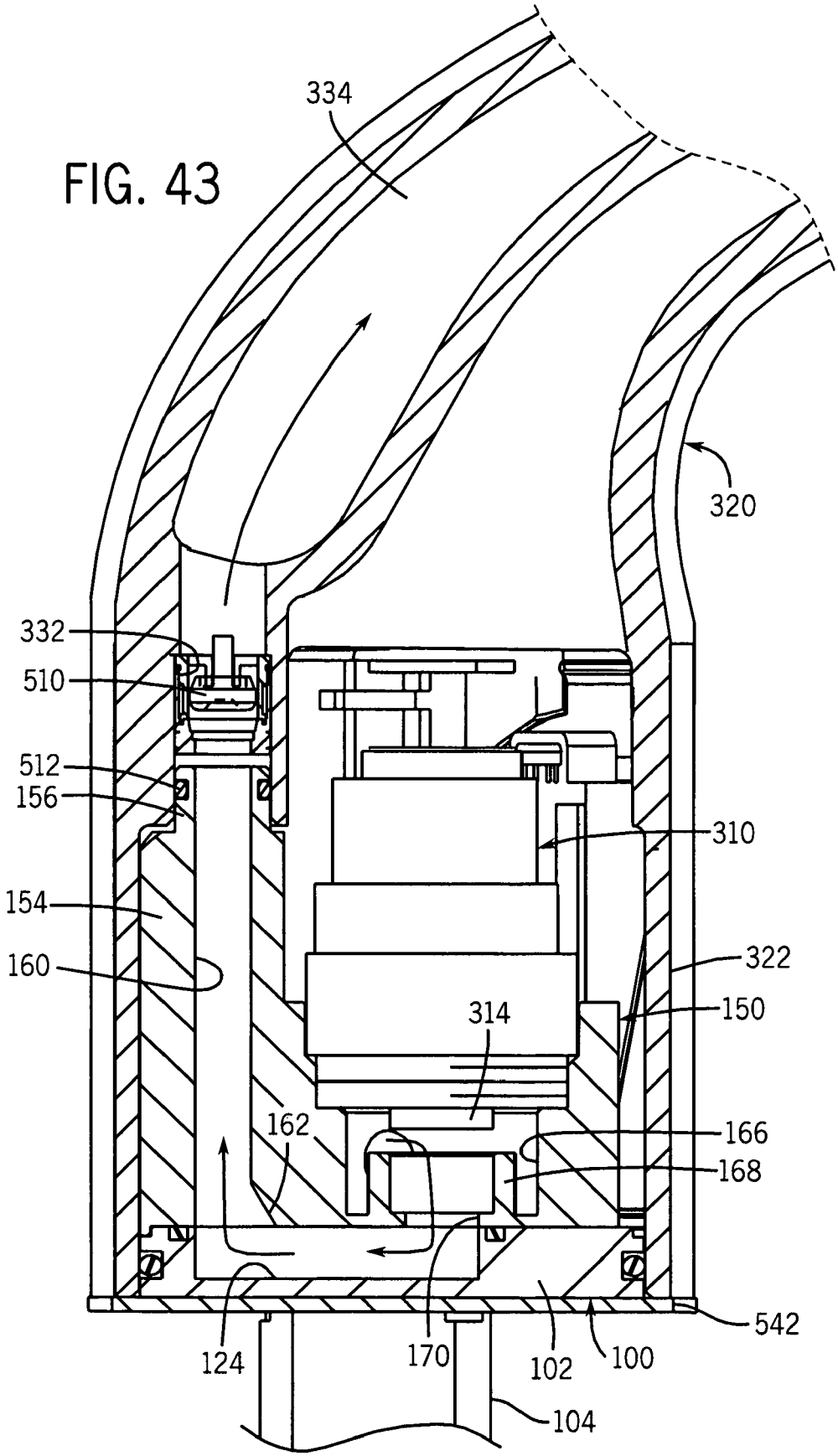
FIG. 43 is a third cross-sectional view of selected components of the assembled modular electrically-operated faucet of the present invention, showing the flow of water through passages in said the upper and lower housing members.

Referring now to FIGS. 41 through 43, the flow of water through the modular electrically-operated faucet of the present invention is illustrated. Hot water is supplied from the flexible supply tube 520, as best shown in FIG. 41. The hot water flows through the check valve 506 and into the hot water inlet 108 in the lower housing member 100, again as shown in FIG. 41. Referring now to FIG. 42, the hot water flows from the hot water inlet 108 to the passageway 114 in the lower housing member 100, and then through the aperture 178 in the upper housing member 150 and into the aperture 174 in the upper housing member 150 where the mixing barrel 350 is installed.

Cold water is supplied from the flexible supply tube 522, as best shown in FIG. 41. The cold water flows through the check valve 508 and into the cold water inlet 110 in the lower housing member 100, again as shown in FIG. 41. The cold water flows from the cold water inlet 110 into the passageway 112, once again as shown in FIG. 41. Referring now to FIG. 42, the cold water flows through the passageway 112 in the lower housing member 100, and then through the aperture 180 in the upper housing member 150 and into the aperture 174 in the upper housing member 150 where the mixing barrel 350 is installed. Rotation of the mixing barrel 350 will vary the mixture of hot and cold water, as described above.

Figure 32:
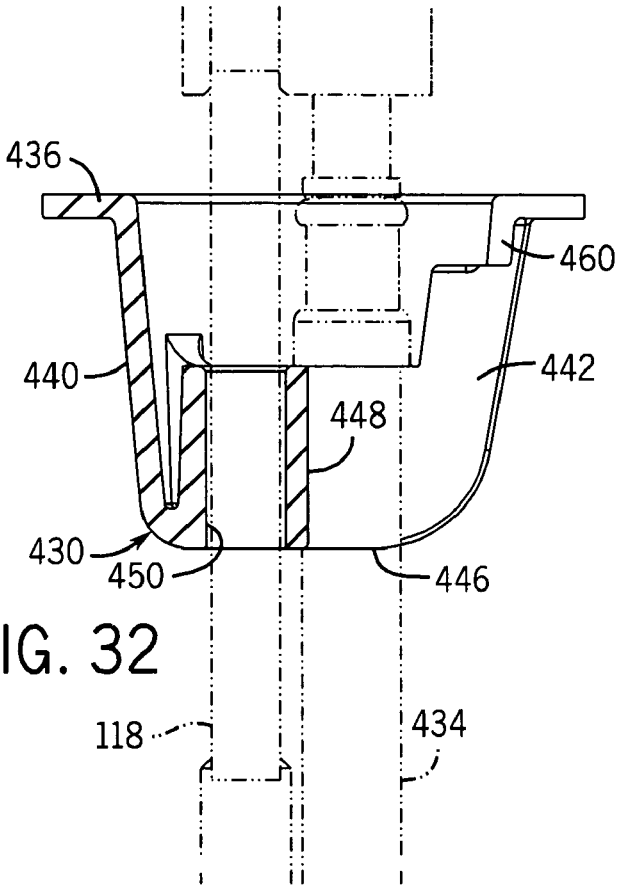
FIG. 32 is a cross-sectional view of the mounting bracket illustrated in FIG. 29 through 31.

Still referring to FIG. 32, from the inside of the mixing barrel 350 in the aperture 174, the mixed water flows through the aperture 176 in the upper housing member 150 and into the cylindrical recess 166 in the upper housing member 150. When the solenoid valve 310 is not energized, the solenoid plunger 314 will be located partially within the cylindrical segment 168 in the upper housing member 150, thereby blocking the flow of mixed water through the modular electrically-operated faucet. When the solenoid valve 310 is energized, the solenoid plunger 314 will be retracted above the cylindrical segment 168, thereby allowing mixed water to flow from the cylindrical recess 166 into the cylindrical segment 168, and then through the aperture 170 in the upper housing member 150 and into the recessed passageway 124 in the lower housing member 100.

Referring now to FIG. 43, the mixed water flows through the recessed passageway 124 in the lower housing member 100, and through the aperture 160 in the upper housing member 150, from which it is supplied to the cylindrical aperture 332 in the faucet spout 320. The mixed water flows through the cylindrical aperture 332 in the faucet spout 320 and the passageway 334 in the faucet spout 320, and will in due course be discharged from the faucet spout 320 through the aerator 338 (shown in FIG. 18).

Figure 44:
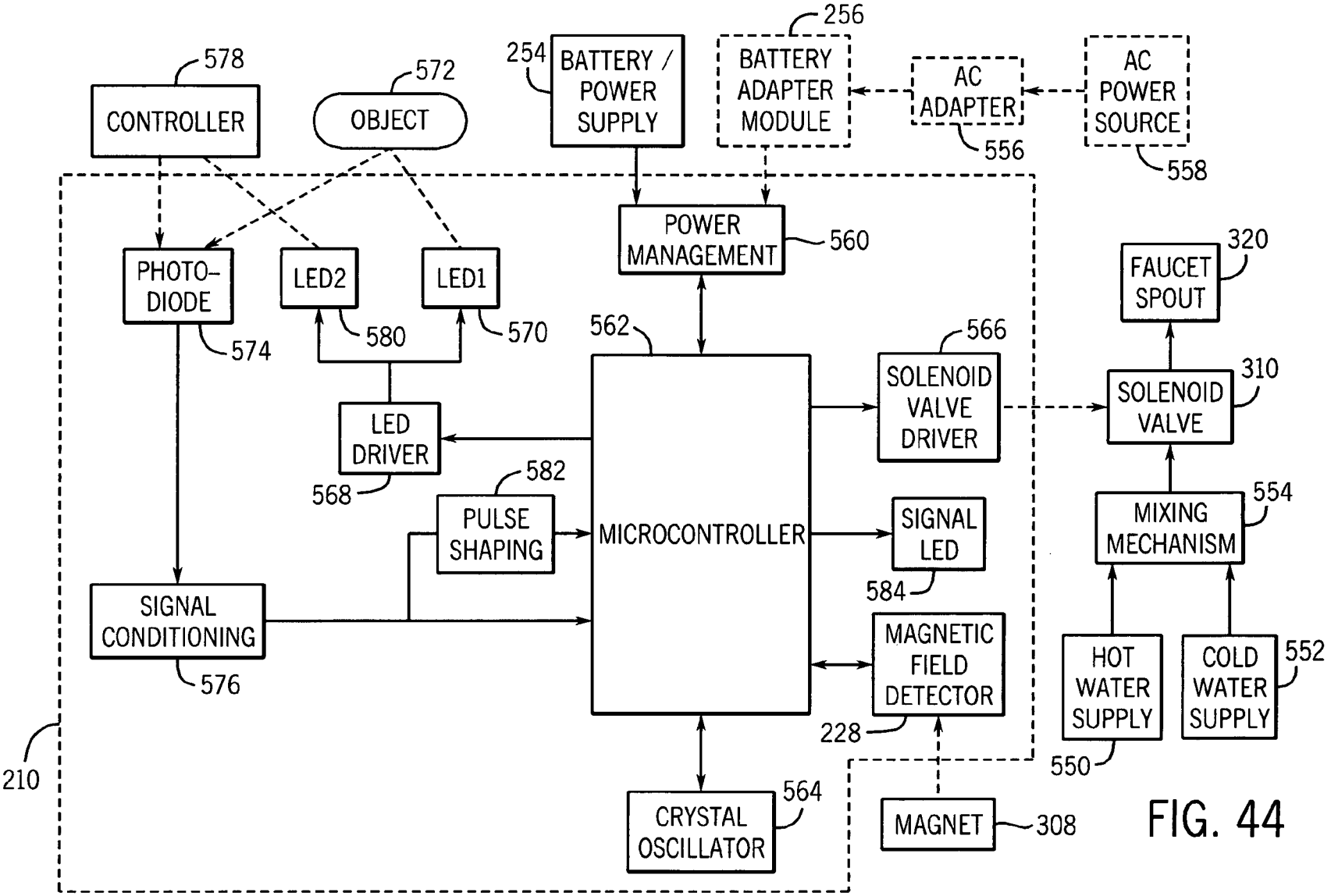
FIG. 44 is a schematic block diagram showing the components of the electronic module illustrated in FIGS. 11 and 12.

The operation of the modular electrically-operated faucet of the present invention may now be described with reference to the schematic flow diagram illustrated in FIG. 44. The components of the modular electrically-operated faucet of the present invention which have been described above are given the same reference numerals in FIG. 44. These components include the electronics module 210 (best shown in FIGS. 11 and 12), the magnetic field detector 228 (best shown in FIG. 12), the replaceable CRP2 lithium battery 254 (best shown in FIG. 13), the battery adapter 256 (best shown in FIG. 14), the solenoid valve 310 (best shown in FIG. 16), and the faucet spout 320 (best shown in FIGS. 17 and 18).

The path of water is illustrated as having a hot water supply 550 and a cold water supply 552, which respectively supply hot and cold water to a mixing mechanism 554. Mixed temperature water from the mixing mechanism 554 is supplied to the solenoid valve 310, the operation of which is controlled by the electronics module 210. Mixed temperature water which is passed by the solenoid valve 310 is then supplied to the faucet spout 320.

Power is supplied to the electronics module 210 either from a replaceable battery 254 or from the battery adapter 256, which itself is electrically connected to an AC adapter 556 which is connected to an AC power source 558. Either the replaceable battery 254 or the battery adapter 256 provides electrical power to a power management module 560 contained in the electronics module 210, which in turn provides power for the modular electrically-operated faucet of the present invention to a microprocessor 562 contained in the electronics module 210, which operates the modular electrically-operated faucet.

The microprocessor 562 is connected to a crystal oscillator 564 which is also contained in the electronics module 210. The crystal oscillator 564 is used to provide a timing signal to the microprocessor 562. The microprocessor 562 is operatively connected to the magnetic field detector 228, also contained in the electronics module 210, which is used to detect the proximity of the magnet 308 (which is contained in the shutoff magnet assembly 300 shown in FIG. 15). The microprocessor 562 operates a solenoid valve driver 566, also contained in the electronics module 210, which is used to selectively operate the solenoid valve 310 to control the flow of water through the modular electrically-operated faucet of the present invention.

The microprocessor 562 is connected to a LED driver 568, also contained in the electronics module 210, which will drive the LED(s) contained in the electronics module 210 and used to generate an optical signal. The LED driver 568 is used to drive a first LED 570, also contained in the electronics module 210, which generates an optical signal used to detect the presence of an object 572 in proximity to the modular electrically-operated faucet of the present invention. If the object 572 is in sufficiently close proximity, it will reflect the optical signal from the first LED 570 back to the electronics module 210 where it will be detected by a photodiode 574, which is also contained in the electronics module 210.

The reflected optical signal detected by the photodiode 574 is supplied to a signal conditioning module 576, also contained in the electronics module 210, which amplifies the reflected optical signal and supplies it to the microprocessor 562. When the microprocessor 562 determines that the object 572 has reflected the optical signal from the first LED 570 back to the photodiode 574, it will cause the solenoid valve driver 566 to operate the solenoid valve 310, opening the flow of water through the modular electrically-operated faucet of the present invention. Typically, the flow of water will continue for a fixed period after the reflected optical signal is no longer detected.

In the preferred embodiment, the modular electrically-operated faucet of the present invention can be programmed by an external controller 578. In this embodiment, a second LED 580, also contained in the electronics module 210, is used to send signals to the controller 578. The photodiode 574 is used to receive signals from the controller 578, which signals are processed by the signal conditioning module 576 and detected by a pulse shaping module 582. Also, in the preferred embodiment the electronics module 210 includes a signal LED 584 which is driven by the microprocessor 562 and is used to generate a visible light signal indicating that the modular electrically-operated faucet needs service.

There are two alternate embodiments which may be implemented for the mixing valve. The preferred embodiment, which has been discussed above, allows the user of the modular electrically-operated faucet of the present invention to adjust the water temperature mix by virtue of its inclusion of an externally-accessible the mixer handle lever 400 (best shown in FIG. 28). A second embodiment shown in FIGS. 45 through 47 allows the water temperature mix to be adjusted by a technician following the removal of the faucet spout 320 (best shown in FIG. 35). In this embodiment, the faucet spout 320 is either manufactured without the valve aperture 326 in the cylindrical base 322 of the faucet spout 320, or a plug (not shown) may be placed into the valve aperture 326.

Referring now to FIGS. 45 through 47, the mixing barrel 350 is shown with a mixer coupling 590 located at one thereof. The mixing barrel 350 is used with the mixer coupling 590 is identical in all respects to its construction as described above in conjunction with FIGS. 19 through 21. The mixer coupling 590 has an annular U-shaped channel 592 into which an O-ring 594 is located to prevent water from flowing out of the aperture 174 into the aperture 172 in the upper housing member 150.

Instead of having the circular flange 362 of the mixer coupling 352 (shown in FIGS. 19 through 21), the mixer coupling 590 has a larger diameter cylindrical segment 596. A smaller diameter cylindrical segment 598 extends coaxially from the end of the mixer coupling 590 opposite the mixing barrel 350. The larger diameter cylindrical segment 596 has an arcuate notch 600 cut into the end thereof which faces the smaller diameter cylindrical segment 598. As shown in FIG. 47, the arcuate notch 600 extends from before three o'clock to after nine o'clock. The notch 600 will serve to drive rotation of the mixer coupling 590 and thus also the mixing barrel 350 to which it is connected, the adjustment allowed will be between 80% cold water to 100% hot water.

The smaller diameter cylindrical segment 598 is cross-cut at the end thereof as indicated by the reference numeral the cross-cut area 602. The cross-cut area 602 in the smaller diameter cylindrical segment 598 will allow the insertion of a flat-bladed screwdriver or a Phillips screwdriver to rotate the mixer coupling 590 and the mixing barrel 350 to adjust the temperature of the mixed water.

A third embodiment shown in FIGS. 48 and 49 allows premixed temperature water or cold water to be supplied to the modular electrically-operated faucet. In this embodiment, only the flexible supply tube 522 will be used to supply premixed temperature water or cold water to the modular electrically-operated faucet. Referring next to FIG. 48, a mixing barrel 610 having a mixer coupling 612 located at one thereof is shown. The mixing barrel 610 is a hollow cylinder which is shorter than the mixing barrel 350 (shown in FIGS. 19 through 21), with the end of the mixing barrel 610 which is connected to the mixer coupling 612 being closed and the other end of the mixing barrel 610 being open. The mixing barrel 610 does not have the triangular openings of the mixing barrel 350 located therein.

In addition and with reference also to FIG. 8, the mixing barrel 610 when installed in the aperture 174 in the upper housing member 150 does not extend to the aperture 180, thereby leaving the aperture 180 open to the aperture 174, and thereby allowing premixed temperature water or cold water to flow from the aperture 180 into the aperture 174, through the aperture 176, and into the cylindrical recess 166 at all times. When the mixing barrel 610 is located in the aperture 174 in the upper housing member 150, the mixer coupling 612 is located in the aperture 172.

The mixer coupling 612 has an annular U-shaped channel 614 into which an O-ring 616 is located to prevent water from flowing out of the aperture 174 into the aperture 172 in the upper housing member 150. The mixer coupling 612 has a circular flange 618 centrally located therein which will fit into the aperture 172 in the upper housing member 150. Located at the end of the mixer coupling 612 opposite the mixing barrel 610 is a cylindrical end 620 which may be used as a handle to push the mixing barrel 610 and the mixer coupling 612 into place in the upper housing member 150.

Figure 4:
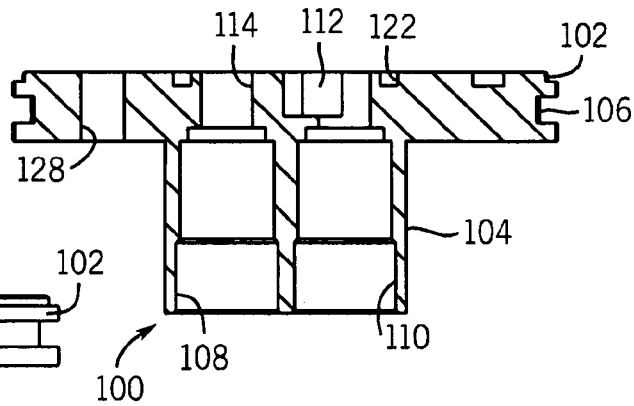
FIG. 4 is a cross-sectional view of the lower housing member illustrated in FIGS. 1 through 3, showing water passages contained in the lower housing member.

Referring now to FIG. 49, a plug 630 is shown which will be installed instead of the flexible supply tube 520 (best shown in FIG. 35) into the hot water inlet 108 of the lower housing member 100 (best shown in FIGS. 2 and 4). The plug 630 has a cylindrical body 632 with having an enlarged head 634 with a U-shaped channel 636 located in the outer periphery of the enlarged head 634 of the plug 630. An O-ring 638 is placed into the U-shaped channel 636. The head of the screw 540 (shown in FIG. 35) covers a portion of the enlarged head 634 of the plug 630 as well as the enlarged head 532 of the water inlet adapter 528, retaining them in place.

Figure 51:
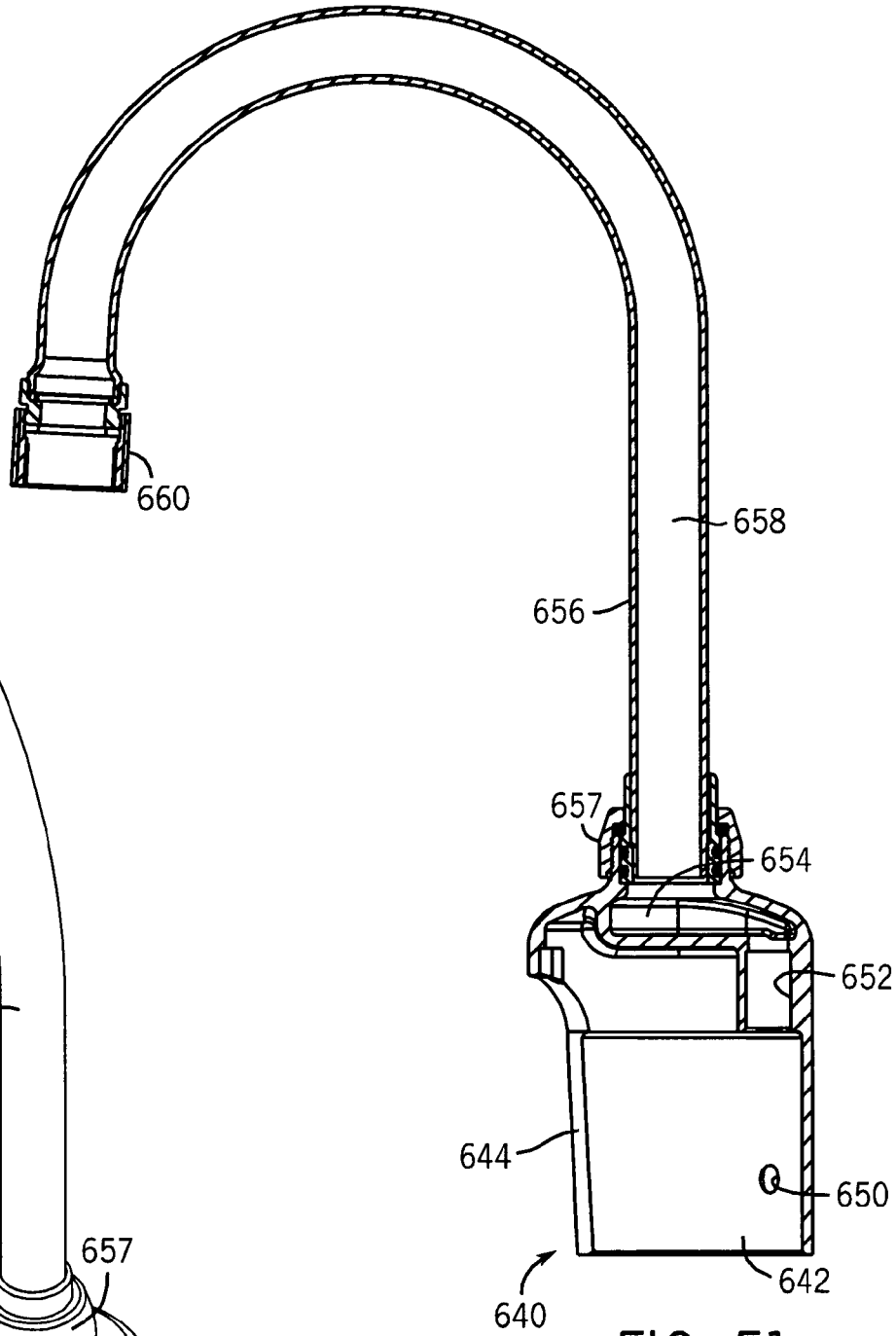
FIG. 51 is a cross-sectional view of the gooseneck faucet spout illustrated in FIG. 50.
Figure 50:
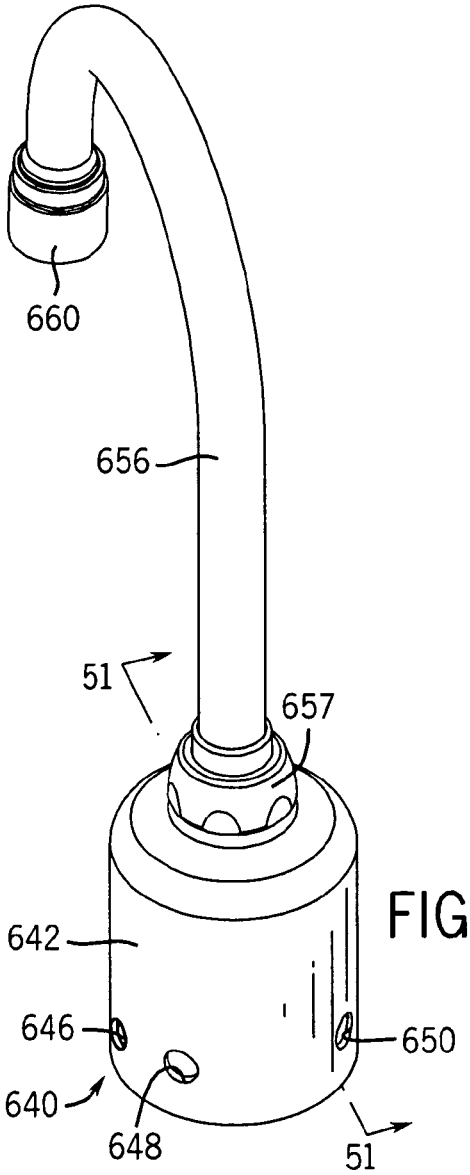
FIG. 50 is a gooseneck faucet spout which may be used in the construction of an alternate embodiment modular electrically-operated faucet instead of the faucet spout illustrated in FIGS. 17 and 18.
Figure 56:
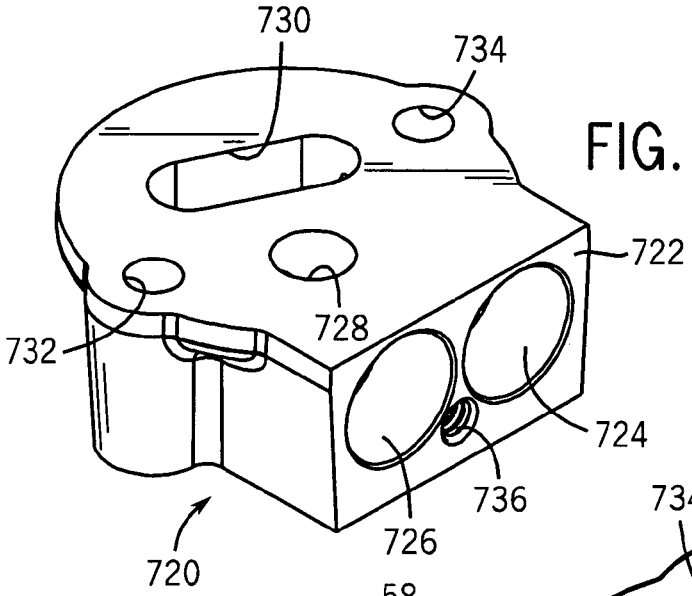
FIG. 56 is an isometric view of a side mount adapter member for use with the lower housing member illustrated in FIGS. 52 through 55.
Figure 57:
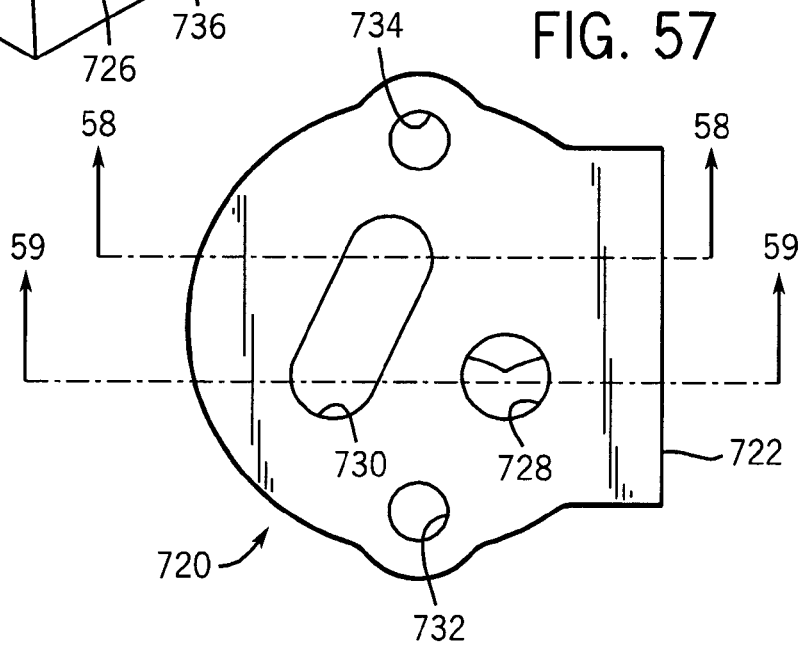
FIG. 57 is a first cross-sectional view of the side mount adapter member illustrated in FIG. 56, showing water passages contained in the side mount adapter housing member.
Figure 58:
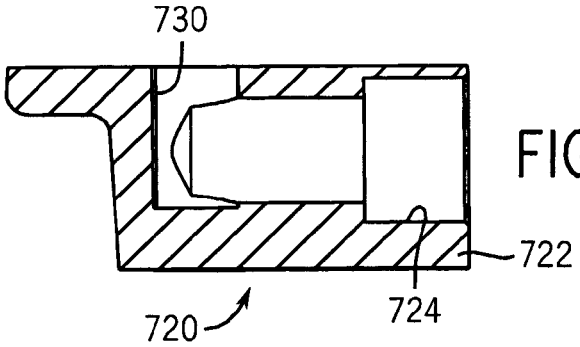
FIG. 58 is a second cross-sectional view of the side mount adapter member illustrated in FIGS. 56 and 57, showing additional water passages contained in the side mount adapter housing member.
Figure 59:
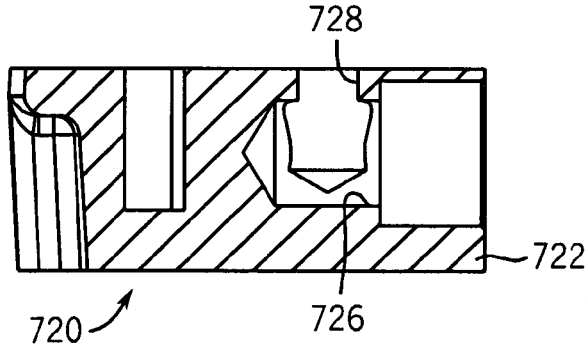
FIG. 59 is an isometric view showing the assembly of the side mount adapter member illustrated in FIGS. 56 through 58 to water inlet hoses within a side mount housing together with mounting hardware used to mount the side mount housing to a wall.

Referring next to FIGS. 50 and 51, a gooseneck faucet spout 640 is shown which can be used instead of the faucet spout 320 (best shown in FIGS. 17 and 18). The gooseneck faucet spout 640 has a hollow cylindrical base 642 having a notch 644 cut out at the front thereof to accommodate the front window housing member 230 (shown in FIG. 12) therein. The cylindrical base 642 of the gooseneck faucet spout 640 has a larger valve aperture 646 located on one side of the cylindrical base 642 near the bottom thereof, and two smaller countersunk apertures 648 and 650 which are spaced apart and are located on the rear side of the cylindrical base 642 thereof near the bottom thereof. When the gooseneck faucet spout 640 is installed onto the modular electrically-operated faucet of the present invention, the bottom of the cylindrical base 642 will fit over both the upper housing member 150 and the lower housing member 100, with the apertures 648 and 650 being respectively aligned with the threaded apertures 194 and 198 in the upper housing member 150 (best shown in FIG. 7).

Located within the cylindrical base 642 near the top thereof and at the back of the gooseneck faucet spout 640 is a cylindrical aperture 652 which communicates with a passageway 654 at the top of the cylindrical base 642. A gooseneck 656 is mounted on the top of the cylindrical base 642 with a gooseneck nut 657, the gooseneck 656 being allowed to rotate about the cylindrical base 642 of the gooseneck faucet spout 640. A passageway 658 in the gooseneck 656 runs to the front of the spout and terminates in an aerator 660. When the faucet spout 640 is installed on the modular electrically-operated faucet of the present invention, the cylindrical aperture 642 will fit over the cylindrical segment 156 extending from the pillar 154 in the upper housing member 150 (best shown in FIG. 7).

Another alternate embodiment is a modification of the modular electrically-operated faucet shown in the preceding figures to have a wall-mount configuration. Referring now to FIGS. 50 through 55, a substitute lower housing member 670 is illustrated which has circular base 672 having a centrally-located cylindrical mounting pillar 674 extending downwardly from the bottom side of the circular base 672. The circular base 672 has two spaced-apart U-shaped channels 676 and 678 located in the outer periphery thereof into which O-rings (not shown in FIGS. 52 through 55) will be located. A hot water inlet 680 and a cold water inlet 682 both extend from the bottom side of the mounting pillar 674 to the top side of the circular base 672, with the hot water inlet 680 and the cold water inlet 682 both having a larger diameter in the mounting pillar 674 and stepping down to a smaller diameter in the circular base 672.

Located in the top side of the circular base 672 and leading from the cold water inlet 682 toward the hot water inlet 680 is a recessed passageway 684. Also located in the top side of the circular base 102 and leading from the hot water inlet 108 and moving in a ninety degree counterclockwise arc is a recessed passageway 686. Located in the bottom side of the mounting pillar 674 near opposite ends of a line between the hot water inlet 680 and the cold water inlet 682 and near the edges of the mounting pillar 674 are two threaded apertures 688 and 690.

Located in the top side of the circular base 672 and surrounding all of the hot water inlet 680, the cold water inlet 682, the passageway 684, and the passageway 686 is a recessed channel 692 into which a gasket (not shown in FIGS. 52 through 55) will be placed. Another recessed passageway 694 is also located in the top side of the circular base 672, and the recessed passageway 694 is surrounded by a recessed channel 696 into which a gasket (not shown in FIGS. 52 through 55) will be placed. Located in and extending through the circular base 672 is an aperture 698 through which a wire for an external power source (not shown in FIGS. 1 through 4) may be threaded.

Extending through the circular base 672 at a location near the side of the recessed channel 696 furthest from the recessed channel 692 is a threaded aperture 700. Extending through the circular base 672 at a location near the side of the recessed channel 692 furthest from the recessed channel 696 is a threaded aperture 702. Extending through the circular base 672 at a location near the edge thereof and adjacent the furthest point of the passageway 686 from the hot water inlet 680 is a threaded aperture 704 which has a cylindrical countersink on the bottom side of the circular base 672. Completing the construction of the lower housing member 670 are two threaded apertures 706 and 708 located near the edge of the circular base 672 on opposite sides of the aperture 698 and close to the edge of the circular base 672.

Referring next to FIGS. 56 through 59, a side mount adapter member 720 is illustrated which will be mounted under the lower housing member 670 (shown in FIGS. 52 through 55). The top side of the side mount adapter member 720 has a configuration which approximately matches the configuration of the mounting pillar 674 of the lower housing member 670 (best shown in FIG. 53). The side mount adapter member 720 has a flat side 722 in which a hot water inlet 724 and a cold water inlet 726 are located. The hot water inlet 724 and the cold water inlet 726 both extend into the interior of the side mount adapter member 720, although the hot water inlet 724 extends substantially further into the side mount adapter member 720 than does the cold water inlet 726. Both the hot water inlet 724 and the cold water inlet 726 step down to a smaller diameter within the side mount adapter member 720.

Located in the top side of the side mount adapter member 720 and extending downwardly into fluid communication with the cold water inlet 726 is a recessed passageway 728. When the side mount adapter member 720 is mounted onto the lower housing member 670, the recessed passageway 728 will be in fluid communication with the cold water inlet 682 in the lower housing member 670 (best shown in FIG. 53). Also located in the top side of the side mount adapter member 720 from a point beyond the furthest point of the cold water inlet 726 and leading to a point at which it is in fluid communication with the hot water inlet 724 is a recessed passageway 730. When the side mount adapter member 720 is mounted onto the lower housing member 670, the passageway 730 will be in fluid communication with the hot water inlet 680 in the lower housing member 670 (best shown in FIG. 53).

Located in the side mount adapter member 720 on opposite sides thereof are two apertures 732 and 734. The threaded aperture 732 is located in the side mount adapter member 720 on the side of the cold water inlet 726 which is away from the hot water inlet 724, and the threaded aperture 734 is located in the side mount adapter member 720 on the side of the hot water inlet 724 which is away from the cold water inlet 726. When the side mount adapter member 720 is mounted onto the lower housing member 670, the apertures 732 and 734 will be respectively aligned with the threaded apertures 688 and 690 in the lower housing member 670 (best shown in FIG. 53). Located in the flat side 722 of the side mount adapter member 720 between and below the hot water inlet 724 and the cold water inlet 726 and near the bottom of the side mount adapter member 720 is a threaded aperture 736.

Referring now to FIGS. 60 and 61, a wall mount housing 740 is shown which includes a cylindrical member 742 having a bottom surface 744. A hollow cylindrical neck 746 is mounted on the side of the cylindrical member 742, and the interior of the cylindrical member 742 is open to the interior of the cylindrical neck 746. The distal portion of the cylindrical neck 746 is threaded as indicated by the reference numeral the threaded portion 748, and the cylindrical neck 746 has a circular flange 750 extending therefrom intermediate the non-threaded portion of the cylindrical neck 746 and the threaded portion 748 of the cylindrical neck 746.

Located in the bottom surface 744 of the wall mount housing 740 are two apertures 752 and 754 which have cylindrical countersinks located on the bottom of the bottom surface 744.

Completing the construction of the wall mount housing 740 is a recessed annular ledge 756 which is located inside the cylindrical member 742 of the wall mount housing 740 at the top end thereof.

Figure 62:
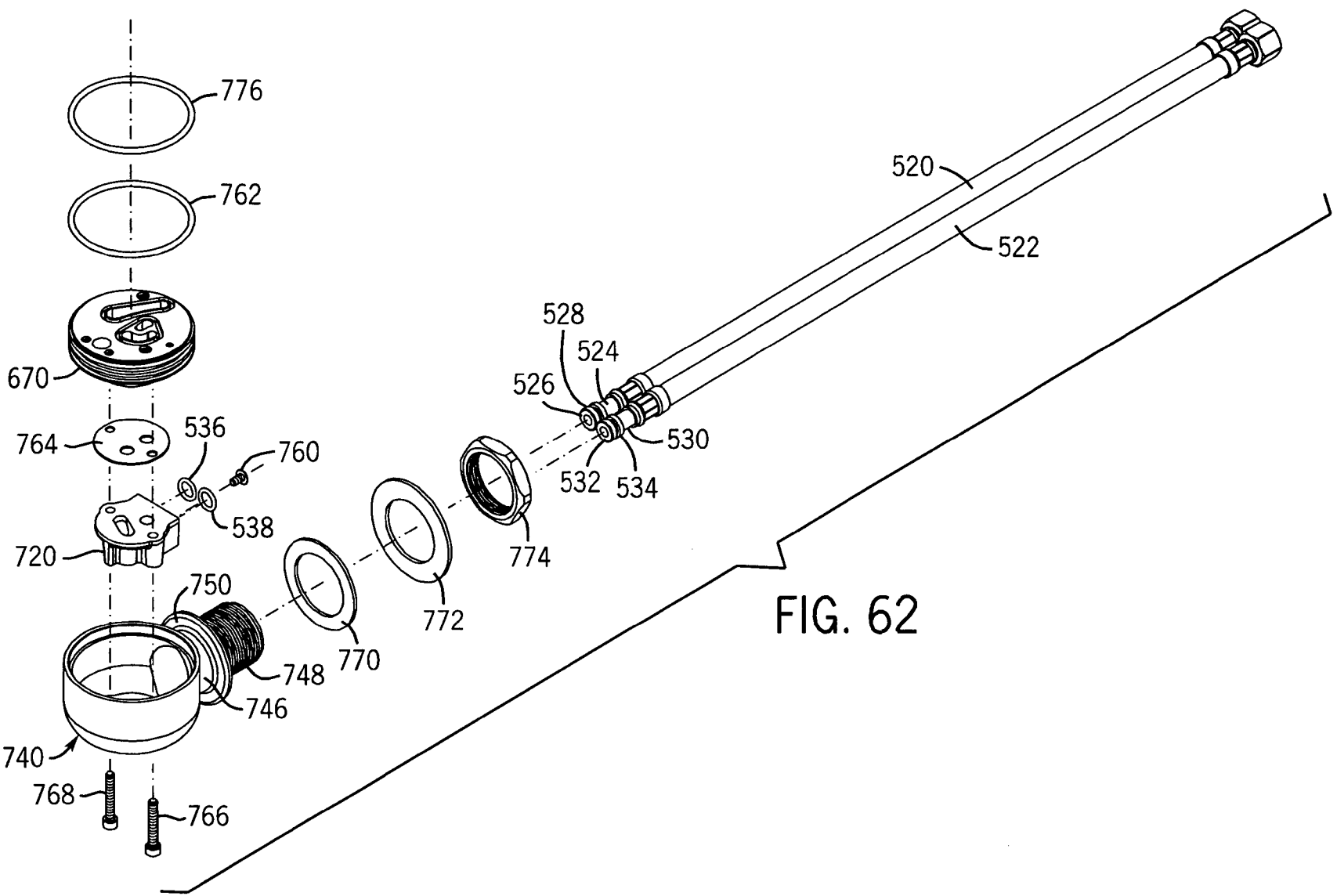
FIG. 62 is an exploded isometric view showing the assembly of the components illustrated in FIGS. 52 through 61 into the bottom portion of the alternate embodiment wall mount modular electrically-operated faucet of the present invention.
Figure 63:
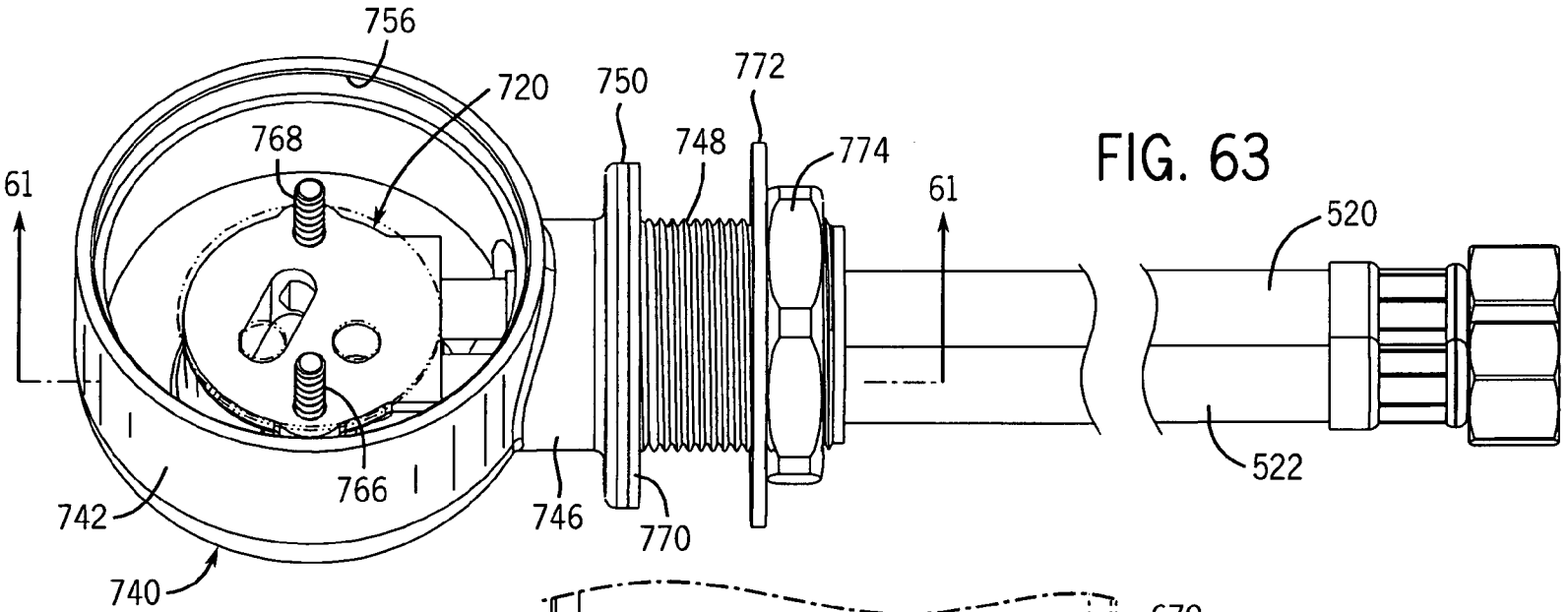
FIG. 63 is a cross-sectional view of the lower housing member, the side mount adapter member, and the wall mount housing shown in FIG. 62.
Figure 64:
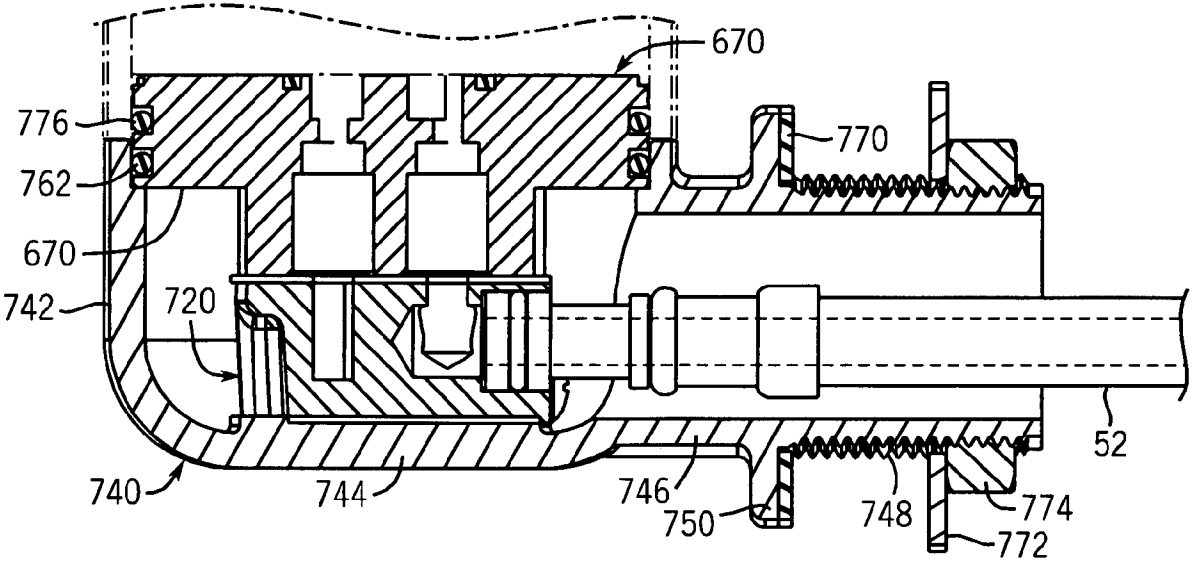
FIG. 64 is an isometric view of the side mount adapter member and the wall mount housing shown in FIGS. 62 and 63.

Referring next to FIGS. 62 through 64, the assembly of the wall-mount version of the modular electrically-operated faucet of the present invention is illustrated. Two flexible supply tubes 520 and 522 are used to supply hot and cold water from water supplies (not shown) to the wall-mount modular electrically-operated faucet. The flexible supply tube 520 has a water inlet adapter 524 having an enlarged head 526 with a U-shaped channel 528 located in the outer periphery of the enlarged head 526 of the water inlet adapter 524. The flexible supply tube 522 has a water inlet adapter 530 having an enlarged head 532 with a U-shaped channel 534 located in the outer periphery of the enlarged head 532 of the water inlet adapter 530.

Two O-rings 536 and 538 are respectively placed into the U-shaped channels 528 and 534. The enlarged head 528 of the water inlet adapter 524 is inserted into the hot water inlet 724 in the side mount adapter member 720 (best shown in FIG. 56), and the enlarged head 532 of the water inlet adapter 530 is inserted into the cold water inlet 726 in the side mount adapter member 720 (also best shown in FIG. 56). A screw 760 is then screwed into the threaded aperture 120 in the lower housing member 100 (again best shown in FIG. 56). The head of the screw 760 covers a portion of the enlarged heads 526 and 532 of the water inlet adapters 524 and 528, respectively, retaining them in place. The distal ends of the flexible supply tubes 520 and 522 are then threaded into the interior of the cylindrical member 742 of the wall mount housing 740, end then through the cylindrical neck 746 and out the distal end thereof. At this point, the side mount adapter member 720 can be moved into its mounted position in the interior of the cylindrical member 742 of the wall mount housing 740, as best shown in FIG. 63.

Figure 35:
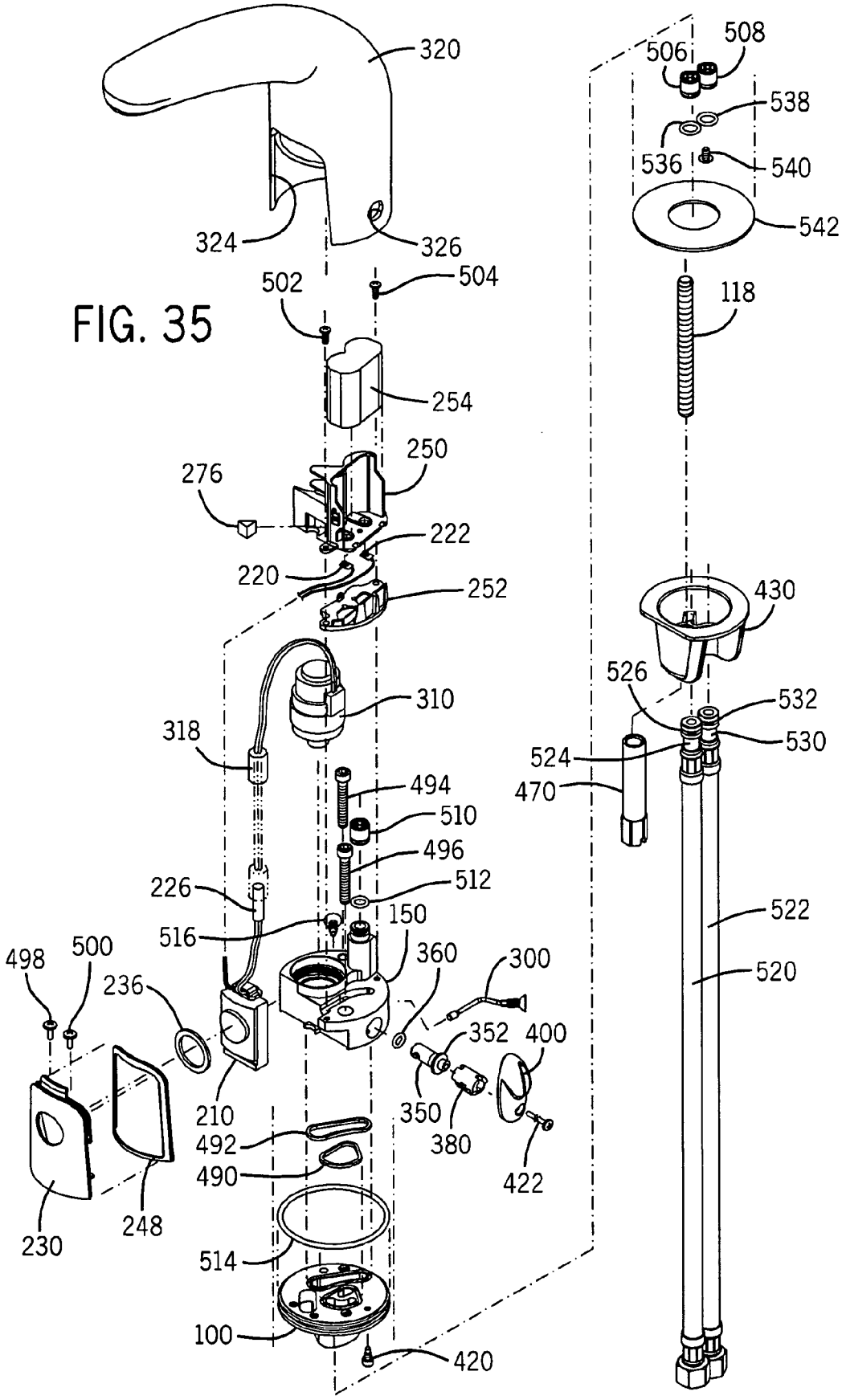
FIG. 35 is an exploded isometric view showing the assembly of the components illustrated in FIGS. 1 through 34 into a first embodiment of the modular electrically-operated faucet of the present invention.
Figure 36:
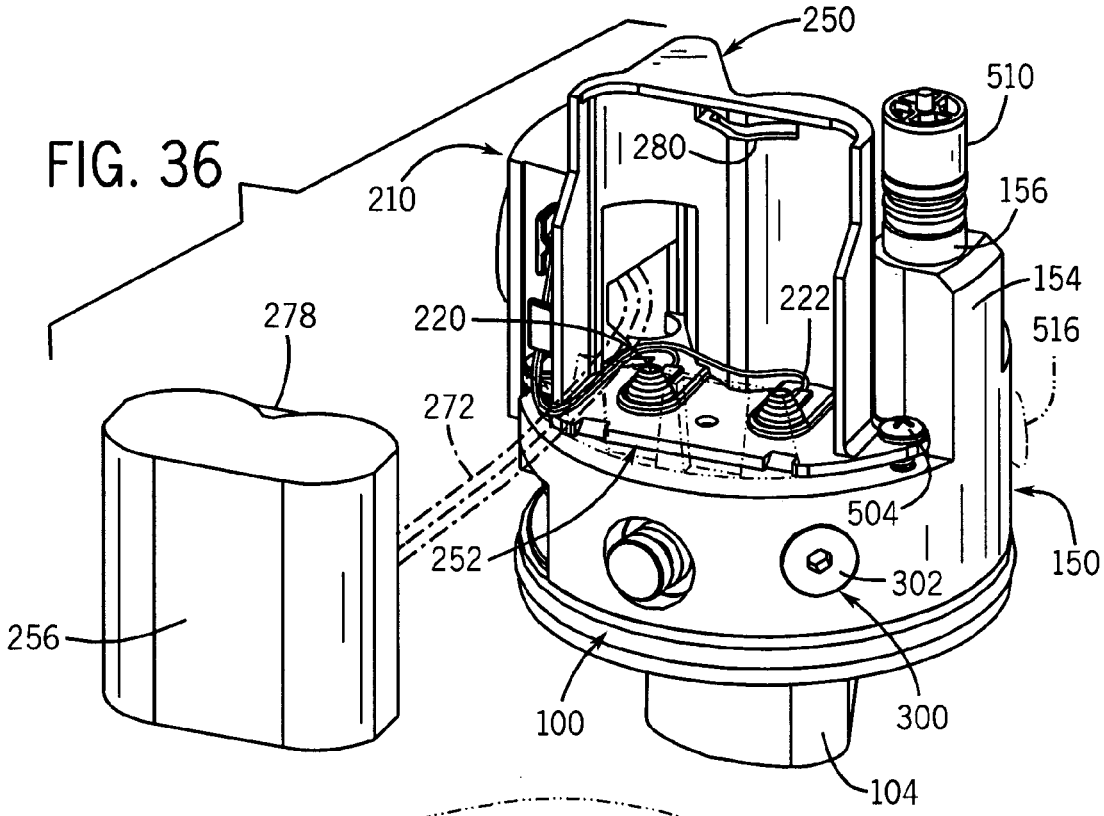
FIG. 36 is an isometric view of the components of the assembled modular electrically-operated faucet of the present invention shown in FIG. 37, showing the installation of a battery into the battery bracket.
Figure 39:
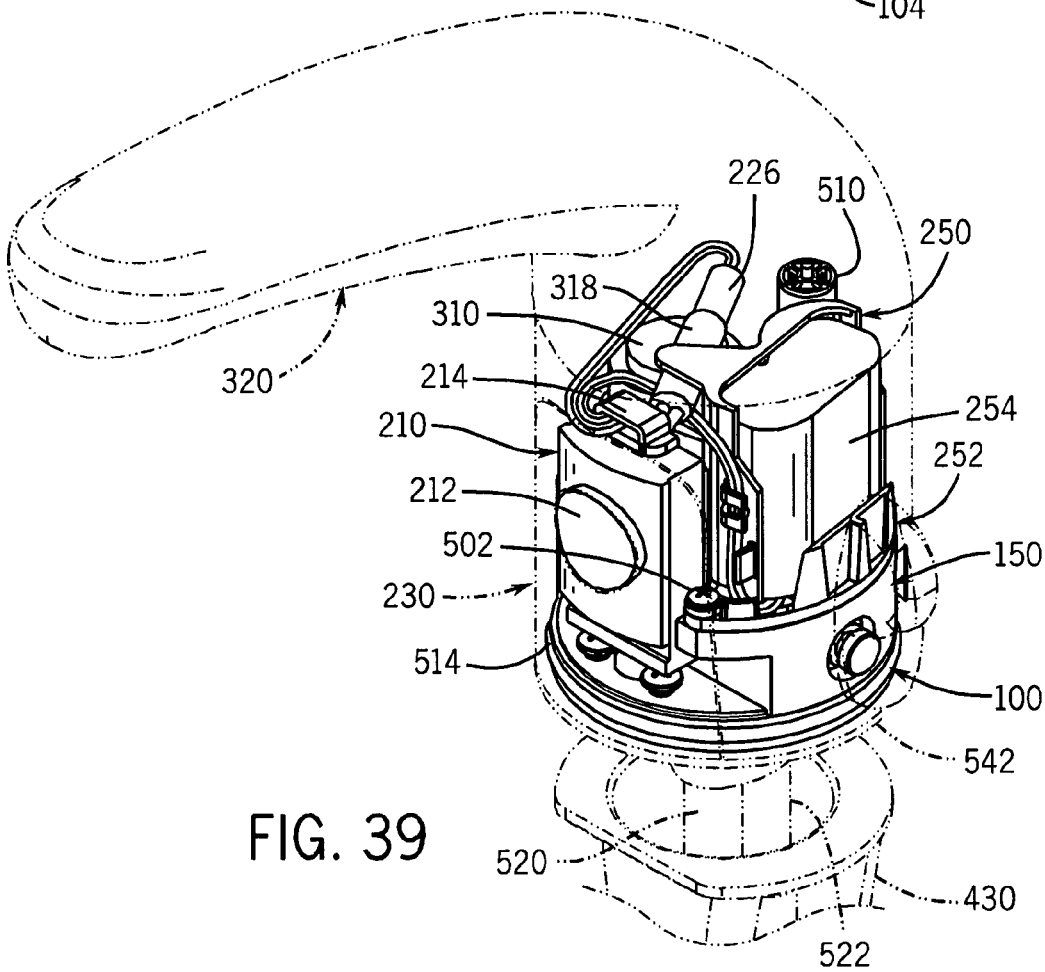
FIG. 39 is an isometric view of the components of the assembled modular electrically-operated faucet of the present invention shown in FIG. 37, showing the location of the mixer assembly.
Figure 37:
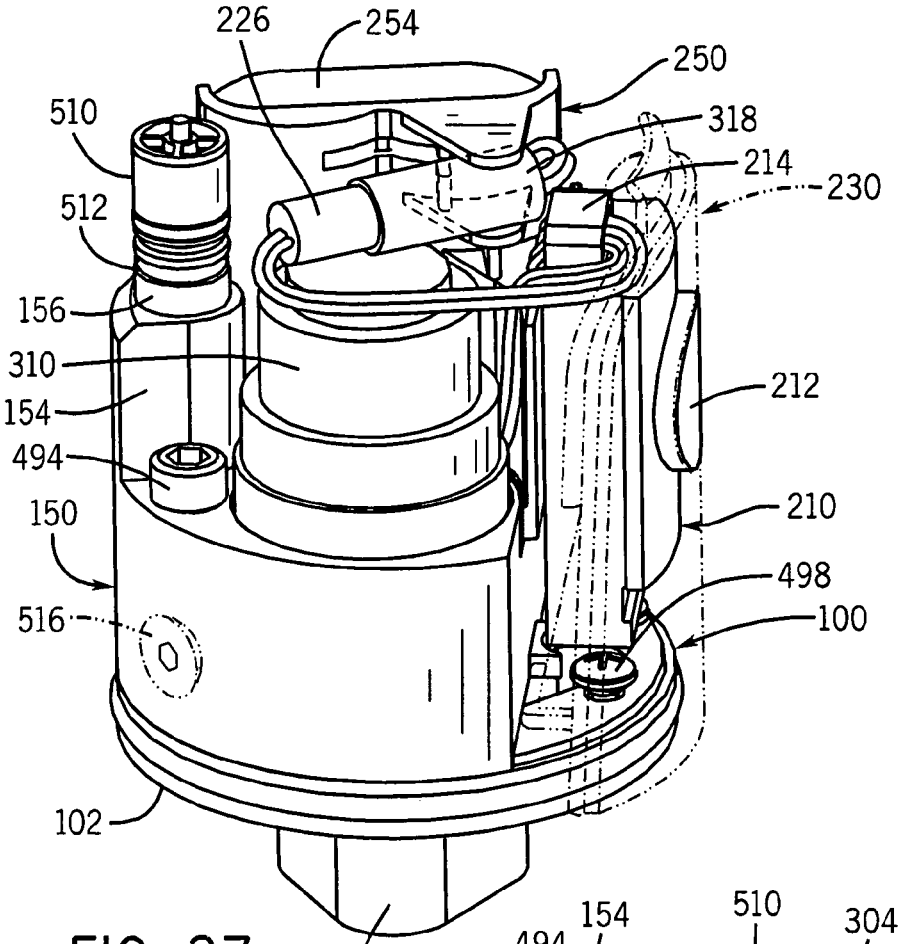
FIG. 37 is an isometric view of components of the assembled modular electrically-operated faucet of the present invention with the faucet spout removed, showing the modular construction of the modular electrically-operated faucet.
Figure 38:
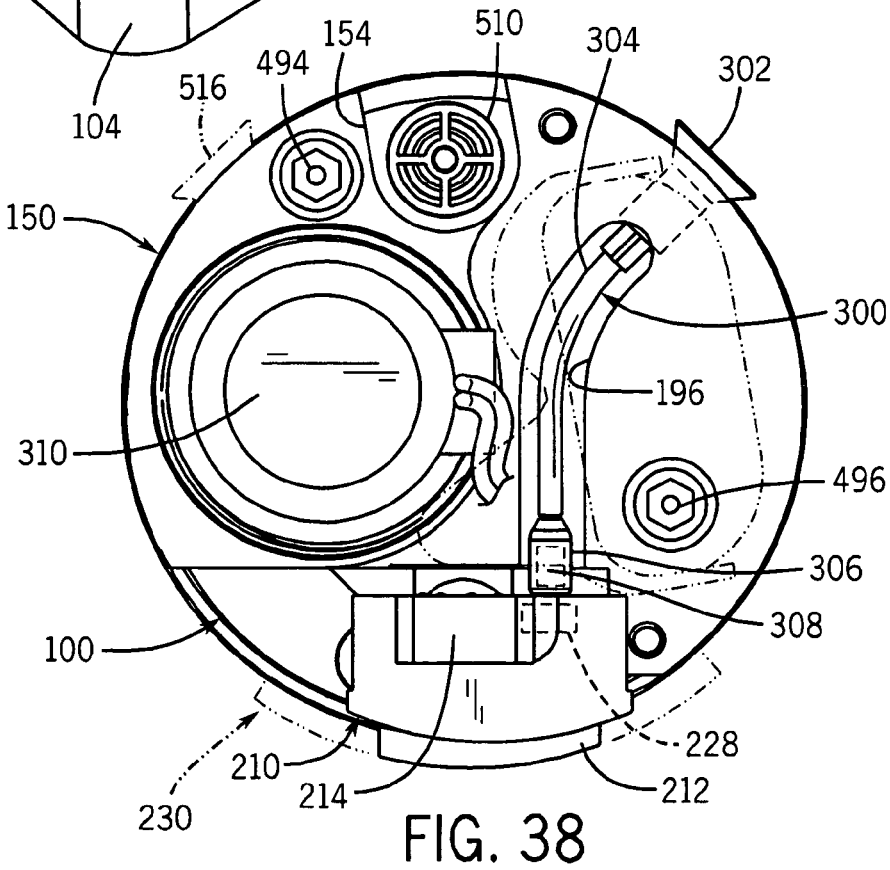
FIG. 38 is a top plan view of the components of the assembled modular electrically-operated faucet of the present invention shown in FIG. 37, with the battery bracket removed to show the location of the shutoff magnet assembly.

Although it is not specifically shown in the figures, the lower housing member 670 is assembled to the upper housing member 150 in the same manner as described above with reference of the assembly of the lower housing member 100 to the upper housing member 150, using the inlet gasket 490, the solenoid gasket 492, the capscrew 494, and the capscrew 496 (all of which are best shown in FIG. 35). The assembly of all of the components onto the upper housing member 150 are also as illustrated in FIG. 35.

An α-ring 762 is placed into the lower U-shaped channel 678 in the lower housing member the circular base 672 of the lower housing member 670 (best shown in FIG. 54). The lower housing member 670 is mounted on top of the side mount adapter member 720 with a waterway gasket 764 located therebetween, as shown in FIG. 62. When the lower housing member 670 is mounted on the side mount adapter member 720, the passageway 730 of the side mount adapter member 720 (best shown in FIGS. 56 and 57) is in fluid communication with the cold water inlet 682 in the lower housing member 670 (best shown in FIG. 53). Similarly, the recessed passageway 728 of the side mount adapter member 720 (again best shown in FIGS. 56 and 57) is in fluid communication with the hot water inlet 680 in the lower housing member 670 (again best shown in FIG. 53).

The lower portion of the circular base 672 of the lower housing member 670 (best shown in FIG. 54) with the O-ring 762 will fit into the annular ledge 756 of the wall mount housing 740 (best shown in FIG. 61). A capscrew 764 is inserted through the aperture 752 in the bottom surface 744 of the wall mount housing 740 (best shown in FIG. 60), through the aperture 732 in the side mount adapter member 720 (best shown in FIGS. 56 and 57), and screwed into the threaded aperture 688 in the lower housing member 670 (also best shown in FIG. 53). A capscrew 766 is inserted through the aperture 754 in the bottom surface 744 of the wall mount housing 740 (best shown in FIG. 60), the aperture 736 through the aperture 734 in the side mount adapter member 720 (best shown in FIGS. 56 and 57), and screwed into the threaded aperture 690 in the lower housing member 670 (also best shown in FIG. 53).

Also shown in FIG. 62 through 64 is hardware which will be used to mount the wall-mount modular electrically-operated faucet onto a wall or other vertical support member. This hardware includes a wall mount gasket 770, a wall mount washer 772, and a wall mount nut 774. The flexible supply tubes 520 and 522 extend through the wall mount gasket 770, the wall mount washer 772, and the wall mount nut 774.

Figure 65:
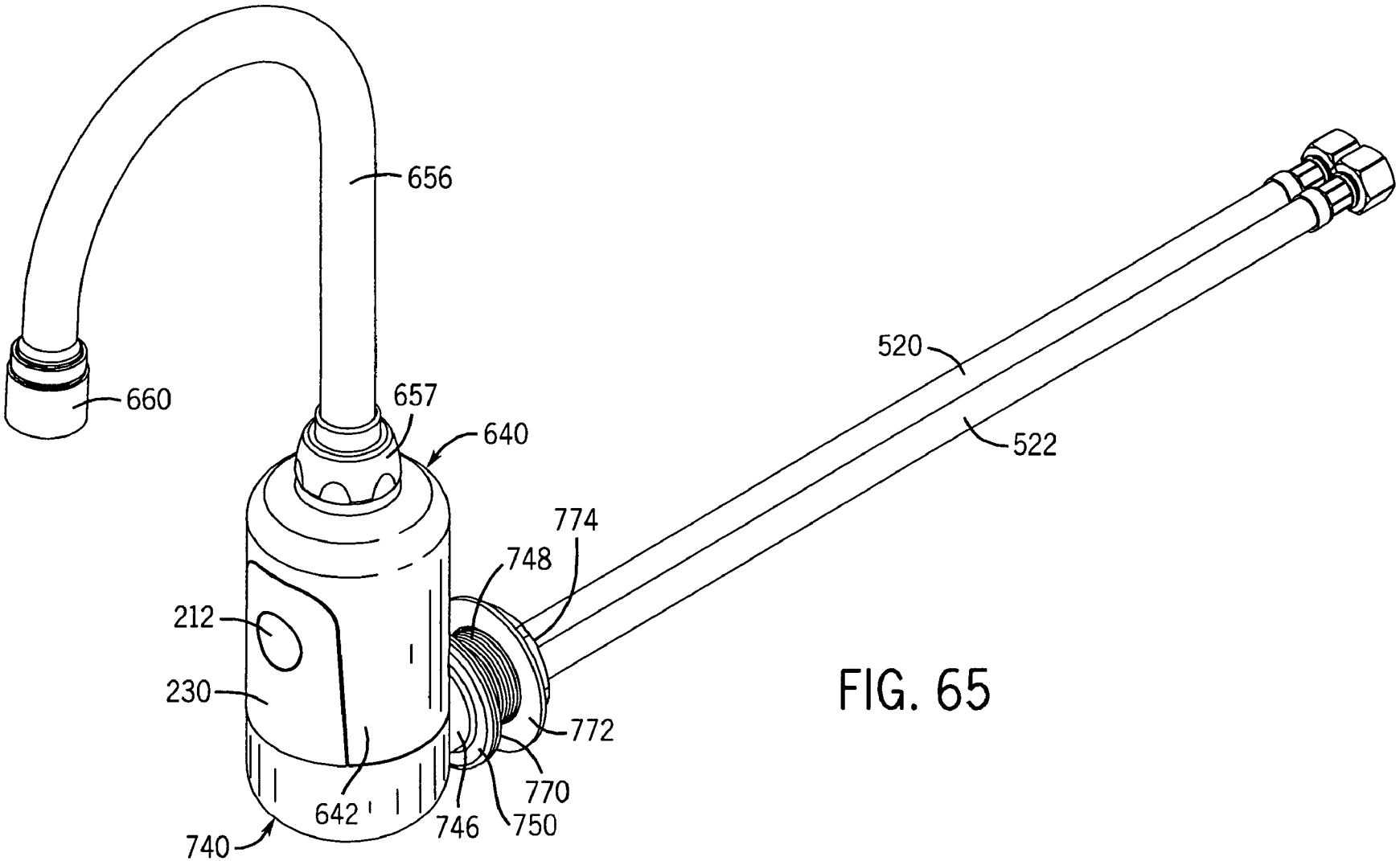
FIG. 65 is an isometric view showing the assembly of an alternate embodiment wall mount modular electrically-operated faucet having a goose neck faucet.

The wall-mount modular electrically-operated faucet of the present invention is completed by mounting a spout on it, typically the gooseneck faucet spout 640 as shown in FIG. 65. Prior to installation of the gooseneck faucet spout 640, an O-ring 776 is placed into the upper U-shaped channel 676 in the lower housing member the circular base 672 of the lower housing member 670 (best shown in FIG. 54). The gooseneck faucet spout 640 is secured in the manner previously described.

Referring finally to FIG. 63, the completely assembled side-mount modular electrically-operated faucet is shown with the gooseneck faucet spout 640 mounted thereupon. It will be appreciated by those skilled in the art that the faucet spout 320 (shown in FIGS. 17 and 18) could be used instead of the gooseneck faucet spout 640.

It may therefore be appreciated from the above detailed description of the preferred embodiment of the present invention that it teaches an electrically-operated faucet of compact one-piece construction which is entirely self-contained. The modular electrically-operated faucet of the present invention that the electrically-operated faucet is of modular construction to make it easy to troubleshoot and to repair. The modular electrically-operated faucet of the present invention makes the broadest possible use of modular components to thereby make all of the components which may typically be replaced over the life of the device easy to remove and replace without necessitating either the complete disassembly or removal of the device. Advantageously, when the modules of the modular electrically-operated faucet of the present invention are accessed for removal and replacement, the flow of water through the device is deactivated.

The modular electrically-operated faucet of the present invention is adaptable to operate with either a long-lasting battery or with a battery replacement module connected to an AC adapter. The modular electrically-operated faucet of the present invention is also configurable to alternatively allow users to adjust the temperature of water supplied from the device, or to allow only a technician to adjust the temperature of water supplied from the device, or to operate with only cold or with water of a premixed temperature supplied to the device. The modular electrically-operated faucet of the present invention is configurable to allow either a conventional faucet spout or a gooseneck spout to be mounted thereupon.

The modular electrically-operated faucet of the present invention is also configurable to be either deck mountable or wall mountable, both of which configurations are easy to install. The modular electrically-operated faucet of the present invention also provides substantially improved mounting hardware to make its installation even easier and quicker to accomplish.

The modular electrically-operated faucet of the present invention is of a construction which is both durable and long lasting, and which is designed to require little or no maintenance to be provided by the user throughout its operating lifetime. The modular electrically-operated faucet of the present invention is also of relatively inexpensive construction as compared to competing devices so to enhance its market appeal and to thereby afford it the broadest possible market. Finally, all of the aforesaid advantages and objectives of the modular electrically-operated faucet of the present invention are achieved without incurring any substantial relative disadvantage.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. An electrically-operated faucet having modular construction for ease of maintenance, said electrically-operated faucet comprising:

a housing adapted to be secured to a support surface, said housing comprising at least one water supply inlet to which a source of water may be connected;

an electrically-operated valve module that is removably installed on said housing to control the flow of water therethrough;

an electronics module that is removably installed on said housing to operate said valve module, said electronics module comprising an optical transmitter that transmits ranging pulses and an optical receiver that detects those of said ranging pulses transmitted from said optical transmitter which are reflected by an object located in a predetermined area;

a power source that is removably installed on said housing to provide electrical power to operate said electronics module and said valve module; and a spout housing that is installed over said housing to enclose said valve module, said electronics module, and said power source thereunder, said spout housing being removable from said housing to access said valve module, said electronics module, and said power source for service thereof;

a bracket mounted on said housing wherein said bracket is designed to receive a battery therein, said bracket having electrical contacts mounted therein, said electrical contacts being electrically connected to said electronics module, said housing having an aperture extending therethrough, and wherein said power source comprises a battery adapter for installation into said bracket, said battery adapter having electrical contacts which contact said electrical contacts mounted in said bracket when said battery adapter is installed in said bracket, said battery adapter having wires connected to said electrical contacts in said battery adapter which wires extend from said battery adapter and through said aperture in said housing; and an AC adapter which is electrically connected to said wires to supply electrical power to said battery adapter when said AC adapter is connected to a source of AC electrical power; wherein said battery adapter is smaller in size than a battery that would be accepted by said bracket, wherein said bracket comprises a notch located therein which notch is spaced away from the top of said bracket;

and wherein said battery adapter comprises a ledge located adjacent the top thereof, said ledge being engaged by said notch in said bracket when said battery adapter is installed in said bracket, wherein the top of said battery adapter is spaced away from the top of said bracket when said battery adapter is installed in said bracket.

2. An electrically-operated faucet as defined in claim 1, additionally comprising:

a removable mechanical securing element which secures said spout housing to said housing; and a sensor located in said electronics module which detects the presence of said securing element.

3. An electrically-operated faucet as defined in claim 2, wherein said valve module is inhibited from being operated to allow the flow of water therethrough whenever said sensor does not detect the presence of said securing element.

4. An electrically-operated faucet as defined in claim 2, wherein said securing element comprises:

a magnet;

and wherein said sensor comprises:

a magnetic field sensor.

5. An electrically-operated faucet having modular construction for ease of maintenance, said electrically-operated faucet comprising:

a housing adapted to be secured to a support surface, said housing comprising at least one water supply inlet to which a source of water may be connected;

an electrically-operated valve module that is removably installed on said housing to control the flow of water therethrough;

an electronics module that is removably installed on said housing to operate said valve module, said electronics module comprising an optical transmitter that transmits ranging pulses and an optical receiver that detects those of said ranging pulses transmitted from said optical transmitter which are reflected by an object located in a predetermined area;

a power source that is removably installed on said housing to provide electrical power to operate said electronics module and said valve module; and a spout housing that is installed over said housing to enclose said valve module, said electronics module, and said power source thereunder, said spout housing being removable from said housing to access said valve module, said electronics module, and said power source for service thereof;

a removable mechanical securing element which secures said spout housing to said housing; and a magnetic field sensor located in said electronics module which detects the presence of said securing element;

wherein said securing element includes a magnet, a screw; a flexible lead connected at one end thereof to a distal end of said screw; and a magnet housing connected to a second end of said flexible lead, said magnet housing containing said magnet;

wherein said spout housing includes an aperture through which said magnet housing, said flexible lead, and said distal end of said screw will extend;

and wherein said housing includes a threaded aperture in said housing through which said magnet housing and said flexible lead will extend and into which said distal end of said screw will extend; and a passageway in said housing leading from said threaded aperture to a location proximate said sensor in said electronics module.

6. An electrically-operated faucet as defined in claim 5, wherein said housing comprises:

a water supply outlet;

and wherein said spout housing comprises:

a passageway connected at a first end thereof to said water supply outlet in said housing, said passageway terminating at a second end thereof in an outlet from which water is discharged.

7. An electrically-operated faucet as defined in claim 5, wherein said spout housing comprises:

a base member for removable installation over said housing; and a gooseneck faucet spout mounted on said base member.

8. An electrically-operated faucet as defined in claim 5, additionally comprising:

a threaded mounting post extending from the bottom side of said housing;

a mounting bracket for installation onto said threaded mounting post to retain said electrically-operated faucet in said support surface; and an extended length mounting nut for installation onto said threaded mounting post to retain said mounting bracket thereupon.

9. An electrically-operated faucet as defined in claim 8, wherein said mounting bracket fits onto said threaded mounting post in a light interference fit.

10. An electrically-operated faucet as defined in claim 8, wherein said extended length mounting nut is engageable with either a wrench or a screwdriver to tighten said extended length mounting nut on said threaded mounting post.

11. An electrically-operated faucet comprising:

a housing adapted to be secured to a support surface;

an electrically-operated valve module that is removably installed on said housing;

an electronics module that is removably installed on said housing to operate said valve module;

a power source that is removably installed on said housing to provide electrical power to operate said electronics module and said valve module;

a spout housing installed over said housing to enclose said valve module, said electronics module, and said power source, said spout housing being removable from said housing to access said valve module, said electronics module, and said power source for service thereof;

an interlock arrangement which inhibits said valve module from being operated to allow the flow of water therethrough when said spout housing is not located on said housing, said interlock arrangement including a removable mechanical securing element which secures said spout housing to said housing, and a magnetic field sensor located in said electronics module which detects the presence of said magnet, thereby detecting the presence of said securing element, wherein said securing element includes a magnet, a screw; a flexible lead connected at one end thereof to a distal end of said screw; and a magnet housing connected to a second end of said flexible lead, said magnet housing containing said magnet;

wherein said spout housing includes an aperture through which said magnet housing, said flexible lead, and said distal end of said screw will extend;

and wherein said housing includes a threaded aperture in said housing through which said magnet housing and said flexible lead will extend and into which said distal end of said screw will extend; and a passageway in said housing leading from said threaded aperture to a location proximate said sensor in said electronics module, whereby said valve module is inhibited from being operated to allow the flow of water therethrough whenever said sensor does not detect the presence of said securing element.

12. An electrically-operated faucet as defined in claim 11, wherein said housing is adapted to be secured to a deck or other horizontal surface.

13. An electrically-operated faucet as defined in claim 11, wherein said housing is adapted to be secured to a wall or other vertical surface.

14. An electrically-operated faucet as defined in claim 13, additionally comprising:

a side mount adapter installed on the bottom of said housing.

15. An electrically-operated faucet as defined in claim 11, wherein said housing comprises:

a hot water supply inlet; and a cold water supply inlet.

16. An electrically-operated faucet as defined in claim 15, additionally comprising:

a mixing valve for adjusting the mix of hot and cold water supplied by said electrically-operated faucet.

17. An electrically-operated faucet as defined in claim 16, wherein said mixing valve is externally adjustable by a user of said electrically-operated faucet.

18. An electrically-operated faucet as defined in claim 16, wherein said mixing valve is adjustable only following the removal of said spout housing from said housing.

19. An electrically-operated faucet as defined in claim 11, wherein said electrically-operated valve module comprises:

a solenoid valve which allows the flow of water when it is electrically energized and prevents the flow of water when it is not electrically energized.

20. An electrically-operated faucet as defined in claim 19, wherein said solenoid valve may be removed by unscrewing it from said housing.

21. An electrically-operated faucet as defined in claim 11, wherein said electronics module is electrically connected both to said power source and to said valve module.

22. An electrically-operated faucet as defined in claim 11, wherein said electronics module comprises:

a sensor window, said optical transmitter and said optical receiver being located in said sensor window.

23. An electrically-operated faucet as defined in claim 22, wherein said window housing member is mounted on said second portion of said housing, said electronics module being mounted behind said window housing member with said sensor window projecting through a sensor aperture located in said window housing member.

24. An electrically-operated faucet as defined in claim 22, wherein said spout housing has a notch located therein for receiving said window housing member therein when said spout housing is installed on said housing.

25. An electrically-operated faucet as defined in claim 11, including a power source bracket mounted on said housing for removably receiving said power source therein, said power source bracket having electrical contacts mounted therein, said electrical contacts being electrically connected to said electronics module.

26. An electrically-operated faucet as defined in claim 25, wherein said power source comprises:

a battery removably received on said power source bracket.

27. An electrically-operated faucet as defined in claim 25, wherein said housing has an aperture extending therethrough, and wherein said power source comprises:

a battery adapter removably received in said power source bracket, said battery adapter having electrical contacts which contact said electrical contacts mounted in said power source bracket when said battery adapter is installed in said power source bracket, said battery adapter having wires connected to said electrical contacts in said battery adapter which wires extend from said battery adapter and through said aperture in said housing; and an AC adapter which is electrically connected to said wires to supply electrical power to said battery adapter when said AC adapter is connected to a source of AC electrical power.

* * * * *

UNITED STATES PATENT AND TRADEMARK OFFICE

CERTIFICATE OF CORRECTION

PATENT NO. : 7,650,653 B2
APPLICATION NO. : 11/273168
DATED : January 26, 2010
INVENTOR(S) : Johnson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1052 days.

Signed and Sealed this

Twenty-third Day of November, 2010

David J. Kappos

David J. Kappos
*Director of the United States Patent and Trademark Office*